US010969719B2

(12) United States Patent
Handa et al.

(10) Patent No.: US 10,969,719 B2
(45) Date of Patent: Apr. 6, 2021

(54) FIXING DEVICE INCLUDING MECHANISM FOR VARYING PRESSURE AT NIP REGION BETWEEN ROTARY BODY AND PRESSURE BODY

(71) Applicant: BROTHER KOGYO KABUSHIKI KAISHA, Nagoya (JP)

(72) Inventors: Hiroshi Handa, Inazawa (JP); Tokifumi Tanaka, Komaki (JP); Shuhei Fukue, Nagoya (JP); Tomonori Watanabe, Ichinomiya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/898,035

(22) Filed: Jun. 10, 2020

(65) Prior Publication Data

US 2020/0401069 A1 Dec. 24, 2020

(30) Foreign Application Priority Data

Jun. 21, 2019 (JP) ..... JP2019-115108

(51) Int. Cl.
*G03G 15/20* (2006.01)

(52) U.S. Cl.
CPC ..... *G03G 15/2053* (2013.01)

(58) Field of Classification Search
CPC ..... G03G 15/2032; G03G 15/2053; G03G 15/2064; G03G 2215/2009; G03G 2215/2022; G03G 2215/2035
USPC ..... 399/107, 110, 122, 320, 328–331
See application file for complete search history.

(56) References Cited

U.S. PATENT DOCUMENTS

| | | | | |
|---|---|---|---|---|
| 7,894,734 | B2 * | 2/2011 | Sawamura | G03G 15/2064 399/67 |
| 9,046,840 | B2 * | 6/2015 | Takahashi | G03G 15/2032 |
| 10,717,842 | B2 * | 7/2020 | Murayama | G03G 15/2064 |
| 2009/0226227 | A1 | 9/2009 | Furukata et al. | |
| 2011/0318073 | A1 | 12/2011 | Arikawa et al. | |
| 2016/0116876 | A1 | 4/2016 | Onishi | |
| 2016/0291514 | A1 | 10/2016 | Fukunaga | |

(Continued)

FOREIGN PATENT DOCUMENTS

| | | | |
|---|---|---|---|
| JP | 2010-230768 | A | 10/2010 |
| JP | 4730472 | B2 | 4/2011 |
| JP | 2012-8394 | A | 1/2012 |

(Continued)

*Primary Examiner* — Hoan H Tran
(74) *Attorney, Agent, or Firm* — Merchant & Gould P.C.

(57) ABSTRACT

A fixing device includes: a rotary body; a pressure body; a frame supporting the rotary body; and a pressure varying mechanism for providing a nip pressure to a nip region formed between the rotary body and the pressure body. The pressure varying mechanism includes a first spring and a second spring for urging one of the rotary body and the pressure body. The first spring applies a first urging force, and the second spring applies a second urging force acting in an opposite direction from the first urging force. The pressure varying mechanism can vary the nip pressure between a first nip pressure and a second nip pressure smaller than the first nip pressure. The nip pressure becomes the first nip pressure while only the first urging force is applied, and becomes the second nip pressure while both of the first urging force and the second urging force are applied.

20 Claims, 12 Drawing Sheets

(56) References Cited

U.S. PATENT DOCUMENTS

2018/0341203 A1 11/2018 Ishida

FOREIGN PATENT DOCUMENTS

| | | | |
|---|---|---|---|
| JP | 2016-85342 | A | 5/2016 |
| JP | 2017-198824 | A | 11/2017 |
| JP | 2017-227937 | A | 12/2017 |
| JP | 2018-197814 | A | 12/2018 |

* cited by examiner

FIXING DEVICE INCLUDING MECHANISM FOR VARYING PRESSURE AT NIP REGION BETWEEN ROTARY BODY AND PRESSURE BODY

CROSS REFERENCE TO RELATED APPLICATION

This application claims priority from Japanese Patent Application No. 2019-115108 filed Jun. 21, 2019. The entire content of the priority application is incorporated herein by reference.

TECHNICAL FIELD

The present disclosure relates to a fixing device for fixing a developer image on a sheet and an image-forming apparatus including the fixing device.

BACKGROUND

As an example of a conventional fixing device, Japanese Patent No. 4730472 discloses a fixing device that includes: a heating member for heating a sheet; a pressure pad configured to nip the sheet together with the heating member; two springs for pressing the heating member toward the pressure pad; and a nip-pressure adjustment mechanism for adjusting urging forces of the springs applied to the heating member to vary a nip pressure applied to the sheet. Specifically, in this fixing device, one of the two springs applies the urging fore to the heating member for applying weak nip pressure to the sheet, and both of the two springs apply urging forces thereof to the heating member for applying intense nip pressure to the sheet.

SUMMARY

According to one aspect, the disclosure provides a fixing device including: a rotary body; a pressure body configured to form a nip region in cooperation with the rotary body; a frame supporting the rotary body; and a pressure varying mechanism configured to provide a nip pressure to be applied to the nip region formed between the rotary body and the pressure body. The pressure varying mechanism includes a first spring and a second spring. The first spring is configured to apply a first urging force to one of the rotary body and the pressure body, the first urging force acting in a first urging direction. The second spring is configured to apply a second urging force to the one of the rotary body and the pressure body, the second urging force acting in a second urging direction opposite to the first urging direction. The pressure varying mechanism is configured to vary the nip pressure to be applied to the nip region between a first nip pressure and a second nip pressure smaller than the first nip pressure. The first nip pressure is applied to the nip region while the first urging force of the first spring is applied to the one of the rotary body and the pressure body without application of the second urging force of the second spring to the one of the rotary body and the pressure body. The second nip pressure is applied to the nip region while both of the first urging force of the first spring and the second urging force of the second spring are applied to the one of the rotary body and the pressure body.

According to another aspect, the disclosure provides a fixing device including a roller, a belt, a pad, a supporting member, a frame, an arm, a first spring, a second spring, and a cam. The pad is configured to nip the belt in cooperation with the roller. The supporting member supports the pad. The frame supports the roller. The arm is pivotally movably supported by the frame and supports the supporting member. The first spring connects the arm to the frame and urges the pad toward the roller through the supporting member. The second spring is configured to urge the pad in a direction opposite to a direction in which the first spring urges the pad. The cam is pivotally movably supported by the frame and is configured to move the arm between a first posture and a second posture different from the first posture. The cam is configured to shift a state of the second spring between a first deformed state and a second deformed state more deformed than the first deformed state while maintaining the arm in the first posture.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

A fixing device 8 according to an embodiment of the present disclosure will now be described in detail with reference to the accompanying drawings.

<Overall Structure of the Image-Forming Apparatus 1>

Figure 1:
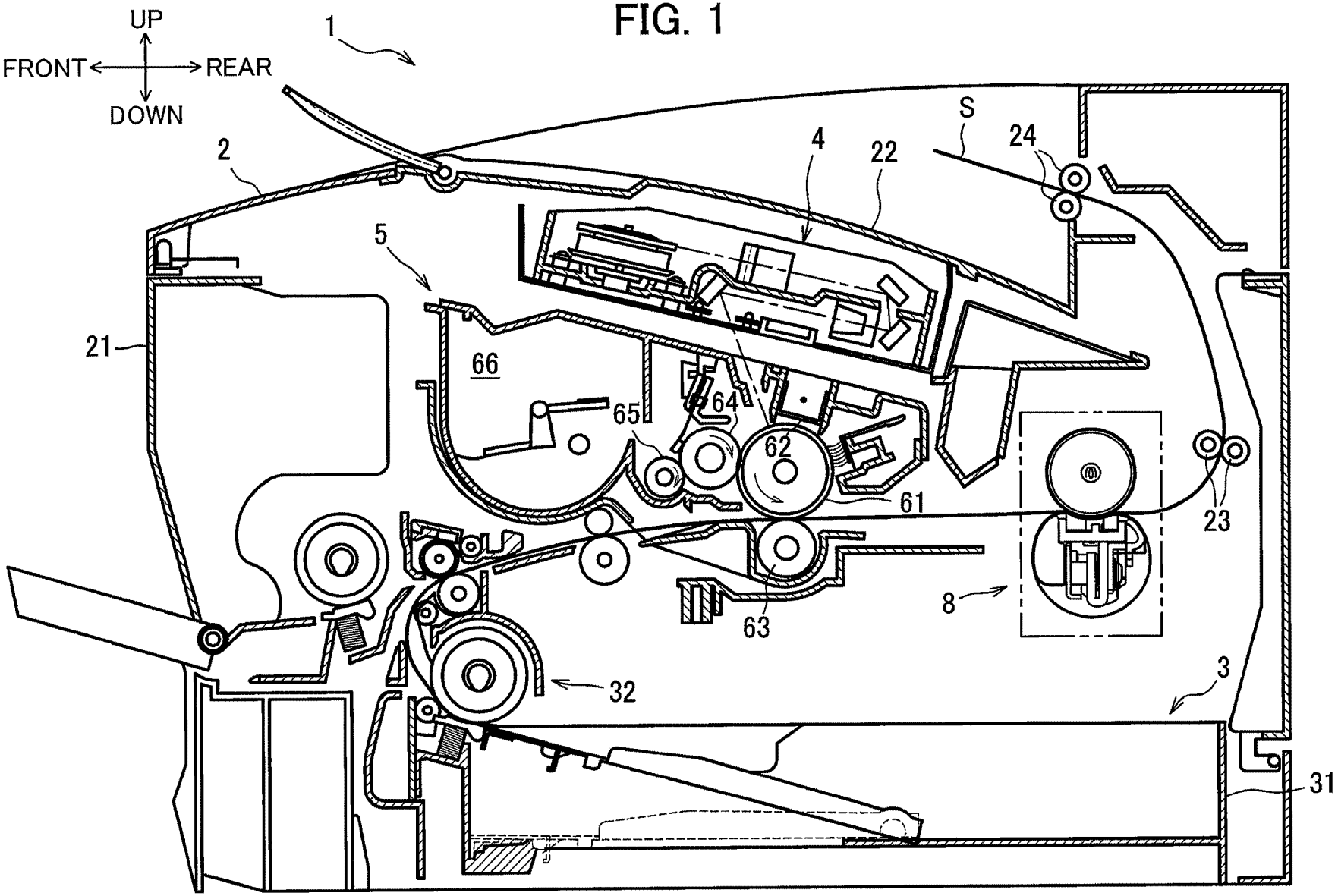
FIG. 1 is a schematic cross-sectional view of a laser printer incorporating a fixing device according to an embodiment.

As illustrated in FIG. 1, the fixing device 8 according to the embodiment is incorporated in an image-forming apparatus 1, such as a laser printer. The image-forming apparatus 1 includes a main casing 2, a sheet feeding unit 3, an exposure device 4, a developer-image forming unit 5, and the fixing device 8.

The sheet feeding unit 3 is disposed in a lower end portion of the main casing 2. The sheet feeding unit 3 includes a sheet tray 31 and a sheet feeding mechanism 32. The sheet tray 31 is configured to accommodate sheets S (sheets of paper, for example) therein. The sheets S in the sheet tray 31 is configured to be fed, one by one, to the developer-image forming unit 5 by the sheet feeding mechanism 32.

The exposure device 4 is disposed in an upper portion of the main casing 2. The exposure device 4 includes a light source (not illustrated), and components such as a polygon mirror, a lens, and reflective mirrors (illustrated without reference numbers). The exposure device 4 is configured to perform high-speed scanning on a surface of a photosensitive drum 61, with a light beam emitted from the light source based on image data (as indicated by a dash-dotted line in FIG. 1), thereby exposing the surface of the photosensitive drum 61 to light.

The developer-image forming unit 5 is disposed below the exposure device 4. The developer-image forming unit 5 is in a form of a process cartridge. The developer-image forming unit 5 (process cartridge) is detachable from and attachable to the main casing 2 through an opening thereof. Specifically, the main casing 2 has a front end portion at which a front cover 21 is provided. The opening of the main casing 2 is formed when the front cover 21 is opened.

The developer-image forming unit 5 includes the photosensitive drum 61, a charger 62, a transfer roller 63, a developing roller 64, a supply roller 65, and a developer container 66 configured to store dry toner as developer.

In the developer-image forming unit 5, the surface of the photosensitive drum 61 is charged by the charger 62. The surface of the photosensitive drum 61 is then exposed by the light beam emitted from the exposure device 4, so that an electrostatic latent image based on image data is formed on the surface of the photosensitive drum 61. Further, in the developer-image forming unit 5, the developer stored in the developer container 66 is supplied to the developing roller 64 via the supply roller 65.

Then, the developer on the developing roller 64 is supplied to the electrostatic latent image formed on the photosensitive drum 61 to develop the electrostatic latent image, thereby forming a visible developer image on the photosensitive drum 61. In the developer-image forming unit 5, the developer image on the photosensitive drum 61 is then transferred to a sheet S which is conveyed to a position between the photosensitive drum 61 and the transfer roller 63 from the sheet feeding unit 3, while the sheet S is being conveyed through the position between the photosensitive drum 61 and the transfer roller 63.

The fixing device 8 is disposed rearward of the developer-image forming unit 5. Details of the fixing device 8 will be described later. In the fixing device 8, the developer image formed on the sheet S is thermally fixed thereto, while the image-formed sheet S passes through the fixing device 8. After the developer image is thermally fixed to the sheet S, the sheet S is configured to be discharged, by conveyor rollers 23 and discharge rollers 24, onto an discharge tray 22 formed outside the main casing 2.

<Detailed Structure of the Fixing Device 8>

Figure 2:
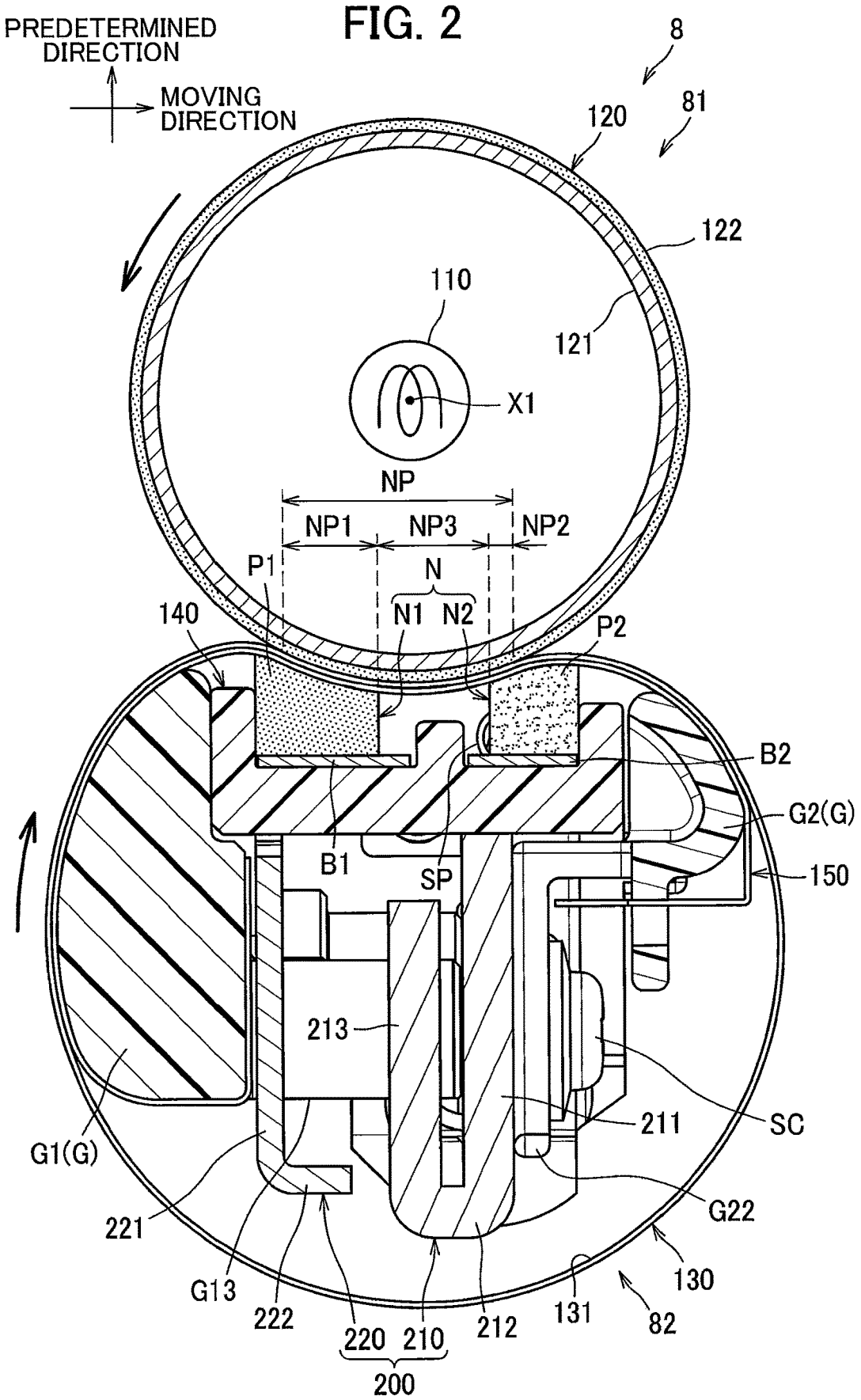
FIG. 2 is a vertical cross-sectional view of the fixing device according to the embodiment.

As illustrated in FIG. 2, the fixing device 8 includes a heating unit 81 and a pressure unit 82. The pressure unit 82 is urged toward the heating unit 81 by a pressure varying mechanism 300 described later (see FIG. 4).

In the following description, a direction in which the pressure unit 82 is urged toward the heating unit 81 will be referred to as a "predetermined direction." Specifically, in the present embodiment, the predetermined direction is a direction orthogonal to a widthwise direction and a moving direction both of which will be described later. The predetermined direction is also a direction in which the heating unit 81 and the pressure unit 82 face each other.

The heating unit 81 includes a heater 110 and a rotary body 120. The pressure unit 82 includes a belt 130, a nip-forming member N, a holder 140, a stay 200, a belt guide G, and a sliding sheet 150.

In the following description, a widthwise direction of the belt 130 will be simply referred to as the "widthwise direction." The widthwise direction is coincident with a direction in which a rotational axis X1 of the rotary body 120 extends, i.e., an axial direction of the rotary body 120. The widthwise direction is orthogonal to the predetermined direction.

The heater 110 is a halogen lamp. When energized, the heater 110 is configured to emit light and generate heat, so that the rotary body 120 can be heated by radiant heat. The heater 110 is disposed inside the rotary body 120 to extend along the rotational axis X1 of the rotary body 120.

The rotary body 120 is a hollow cylindrical roller extending in the widthwise direction. The rotary body 120 is configured to be heated by the heater 110. The rotary body 120 includes a bare pipe 121 and an elastic layer 122. The bare pipe 121 is made of metal, for example. The elastic layer 122 covers an outer circumferential surface of the bare pipe 121. The elastic layer 122 is made of rubber, such as silicone rubber.

In the present embodiment, the rotary body 120 has a concave shape whose outer diameter is greater at each end portion than at a center portion in the widthwise direction. That is, the outer diameter of the rotary body 120 gradually increases from its center portion toward both ends in the widthwise direction. However, the rotary body 120 may have a shape other than the concave shape. For example, the rotary body 120 may be, for example, a hollow cylindrical roller having a constant outer diameter with respect to the widthwise direction. Alternatively, the rotary body 120 may be a crown-shaped roller whose outer diameter is reduced from a center thereof toward each end in the widthwise direction.

The rotary body 120 is rotatably supported by a pair of side frames 83 (see FIG. 4), as will be described later. Upon receipt of a driving force from a motor (not illustrated) disposed inside the main casing 2, the rotary body 120 is configured to rotate in a counterclockwise direction as indicated by a bold arrow in FIG. 2.

The belt 130 is a flexible hollow cylindrical-shaped member (endless belt) elongated in the widthwise direction.

Although not illustrated, the belt 130 has a base material made of metal or resin, and a releasing layer covering an outer circumferential surface of the base material. The belt 130 is circularly movable in a clockwise direction indicated by another bold arrow in FIG. 2, following rotation of the rotary body 120, by friction generated between the belt 130 and the rotary body 120 or the sheet S during the rotation of the rotary body 120. A lubricant, such as grease, is applied to an inner peripheral surface 131 of the belt 130. The nip-forming member N, the holder 140, the stay 200, the belt guide G, and the sliding sheet 150 are disposed in an internal space provided by the inner peripheral surface 131 of the belt 130.

Figure 3:
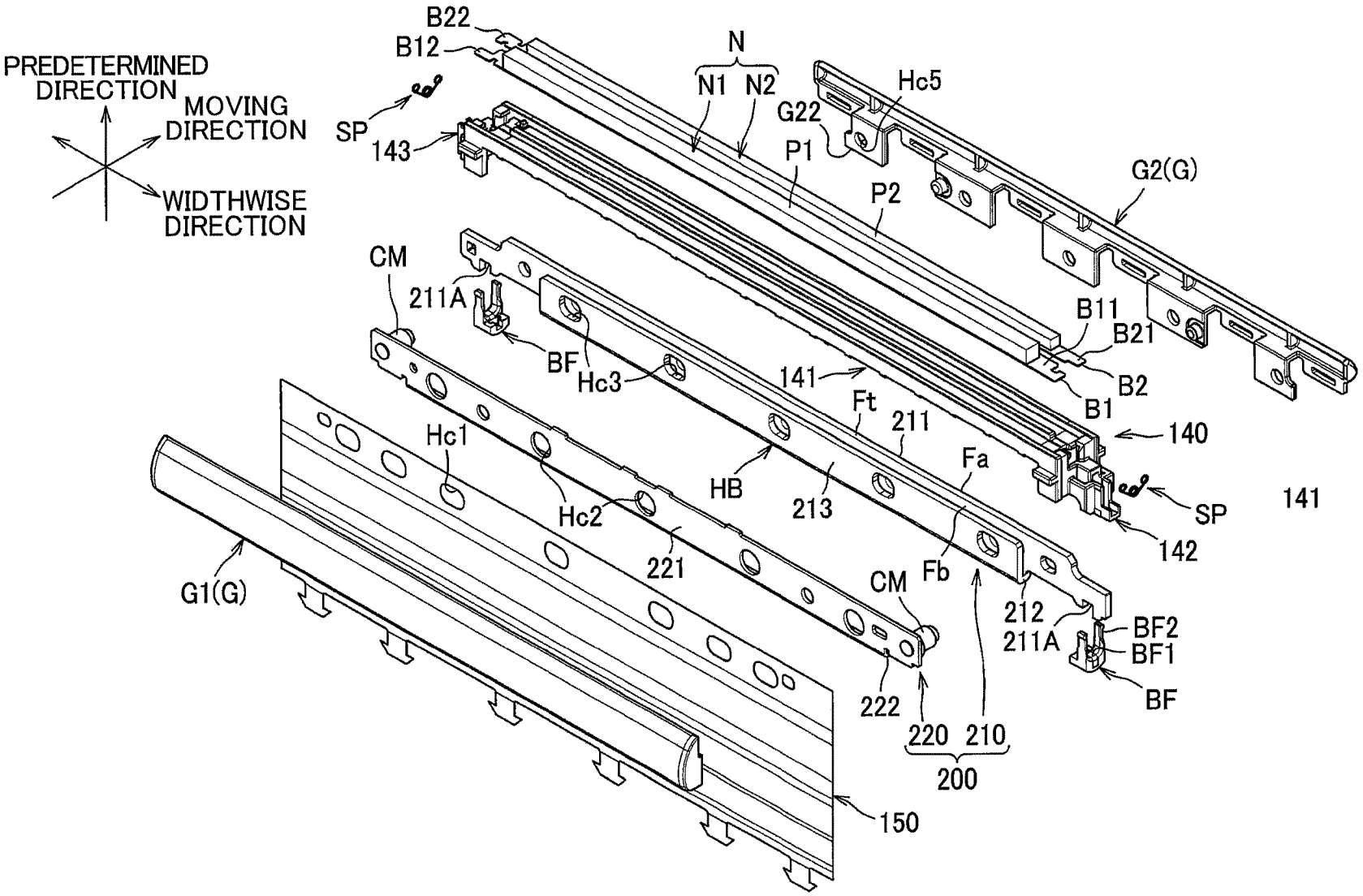
FIG. 3 is an exploded perspective view illustrating components disposed inside a loop of an endless belt of the fixing device according to the embodiment.

In other words, the nip-forming member N, the holder 140, the stay 200, the belt guide G, and the sliding sheet 150 are all covered by the belt 130. Here, the holder 140 and the stay 200 function to support the nip-forming member N. As illustrated in FIG. 3, each of the nip-forming member N, the holder 140, the stay 200, the belt guide G, and the sliding sheet 150 has a widthwise length which is larger than a length in each direction orthogonal to the widthwise direction (i.e., a length in the predetermined direction and a length in the moving direction).

As illustrated in FIGS. 2 and 3, the nip-forming member N and the rotary body 120 nip the belt 130 therebetween to form a nip region NP. The nip-forming member N includes an upstream nip-forming member N1 and a downstream nip-forming member N2.

The upstream nip-forming member N1 includes an upstream pad P1 and an upstream fixed plate B1. The upstream pad P1 has a rectangular parallelepiped shape. The upstream pad P1 is made of rubber, such as silicone rubber. The upstream pad P1 nips the belt 130 in cooperation with the rotary body 120 to form an upstream nip region NP1 between the upstream pad P1 and the rotary body 120.

In the following description, a moving direction of the belt 130 at the nip region NP (and at the upstream nip region NP1) will be simply referred to as the "moving direction." Note that, precisely, the moving direction is actually a direction along the outer circumferential surface of the rotary body 120. However, in the present embodiment, since the moving direction is substantially orthogonal to the predetermined direction and the widthwise direction, the moving direction is assumed and illustrated as a direction orthogonal to the predetermined direction and the widthwise direction. The moving direction is also coincident with a direction in which the sheet S is conveyed at the nip region NP.

The upstream pad P1 is fixed to a surface of the upstream fixed plate B1, the surface facing the rotary body 120. The upstream pad P1 has an upstream edge that is positioned slightly upstream of an upstream edge of the upstream fixed plate B1 in the moving direction. That is, the upstream edge of the upstream pad P1 protrudes slightly toward upstream relative to the upstream edge of the upstream fixed plate B1 in the moving direction.

The upstream fixed plate B1 is made of a material harder than that of the upstream pad P1. For example, the upstream fixed plate B1 is made of metal. The upstream fixed plate B1 has a length greater than a length of the upstream pad P1 in the widthwise direction. The upstream fixed plate B1 has both ends B11 and B12 in the widthwise direction. The ends B11 and B12 are respectively positioned farther outward in the widthwise direction than both ends of the upstream pad P1 in the widthwise direction.

The downstream nip-forming member N2 is positioned downstream of the upstream nip-forming member N1 in the moving direction with a gap therebetween. The downstream nip-forming member N2 includes a downstream pad P2 and a downstream fixed plate B2.

The downstream pad P2 has a rectangular parallelepiped shape. The downstream pad P2 is made of rubber, such as silicone rubber. The downstream pad P2 and the rotary body 120 nip the belt 130 therebetween to form a downstream nip region NP2 between the downstream pad P2 and the rotary body 120. The downstream pad P2 is spaced away from the upstream pad P1 in the moving direction of the belt 130.

Accordingly, an intermediate nip region NP3 is formed between the upstream nip region NP1 and the downstream nip region NP2 in the moving direction. In the intermediate nip region NP3, pressure from the pressure unit 82 is not directly applied to the belt 130. In the intermediate nip region NP3, the belt 130 is in contact with the rotary body 120, but substantially no pressure is applied to the belt 130 since there is no component that nips the belt 130 between the rotary body 120 and the pressure unit 82. As a result, the sheet S passes through the intermediate nip region NP3 without application of substantial pressure, while being heated by the rotary body 120.

In this embodiment, the nip region NP refers to an area from an upstream edge of the upstream nip region NP1 to a downstream edge of the downstream nip region NP2, i.e., an entire contact area between the outer peripheral surface of the belt 130 and the rotary body 120. That is, the nip region NP of the embodiment includes the intermediate nip region NP3, i.e., an area where no pressure is applied from the upstream pad P1 and the downstream pad P2.

The downstream pad P2 is fixed to the face of the downstream fixed plate B2 adjacent to the rotary body 120. The downstream pad P2 protrudes slightly father downstream than the downstream edge of the downstream fixed plate B2 in the moving direction.

The downstream fixed plate B2 is made of a material harder than that of the downstream pad P2. For example, the downstream fixed plate B2 is made of metal. The downstream fixed plate B2 has a length greater than that of the downstream pad P2 in the widthwise direction. The downstream fixed plate B2 has both ends B21 and B22 in the widthwise direction which are respectively positioned farther outward in the widthwise direction than both ends of the downstream pad P2 in the wd in the widthwise direction.

Incidentally, the upstream pad P1 has a hardness higher than that of the elastic layer 122 of the rotary body 120. The downstream pad P2 has a hardness higher than the hardness of the upstream pad P1.

Here, the hardness is based on the durometer hardness set forth in ISO7619-1. The durometer hardness is a value obtained by measuring a depth of an indentation made by a prescribed indenter pressed into a test piece under specific conditions. For example, if the durometer hardness of the elastic layer 122 is "5," preferably, the durometer hardness of the upstream pad P1 be within a range of 6 to 10, and the durometer hardness of the downstream pad P2 be within a range of 70 to 90.

Incidentally, the hardness of silicone rubber can be adjusted by varying a ratio of an additive (such as silica filler or carbon filler) to be added during manufacturing. Specifically, as the ratio of the additive increases, the hardness of the rubber becomes higher. The hardness of the silicone rubber can be lower by adding silicon-based oil. Liquid injection molding or extrusion molding may be available for processing silicone rubber. Generally, liquid injection molding is suitable for processing rubber with a lower hardness, while extrusion molding is suitable for processing rubber with a higher hardness.

The upstream nip-forming member N1 and the downstream nip-forming member N2 are respectively urged in directions away from each other by a pair of springs SP. The springs SP are torsion springs. Each spring SP has: a coiled portion supported by the holder 140; one end portion in contact with the upstream nip-forming member N1; and another end portion in contact with the downstream nip-forming member N2. The springs SP are disposed respectively at both end portions of the holder 140 in the widthwise direction.

The holder 140 holds the nip-forming member N (the upstream nip-forming member N1 and the downstream nip-forming member N2). The holder 140 is made of heat-resistant resin. The holder 140 includes a holder body 141 and two engagement portions 142 and 143.

The holder body 141 holds the nip-forming member N. A major portion of the holder body 141 is disposed in the internal space of the belt 130 in the widthwise direction (in a range corresponding to the widthwise length of the belt 130). The holder body 141 is supported by the stay 200.

The engagement portions 142 and 143 protrude outward in the widthwise direction from respective widthwise ends of the holder body 141. The engagement portions 142 and 143 are positioned outside of the belt 130 in the widthwise direction. The engagement portions 142 and 143 are engaged with respective widthwise ends of the first stay 210, as described below.

The stay 200 supports the holder 140. The stay 200 is positioned opposite to the nip-forming member N with respect to the holder 140. The stay 200 includes a first stay 210 and a second stay 220.

The first stay 210 supports the holder body 141 of the holder 140. The first stay 210 is made of metal. The first stay 210 includes a base 211 and a hem-bent portion HB.

The base 211 has an end surface facing the holder 140. This end surface serves as a contact face Ft in contact with the holder body 141 of the holder 140. The contact face Ft is a flat surface perpendicular to the predetermined direction. The base 211 is positioned downstream of the hem-bent portion HB in the moving direction. Hence, the base 211 serves as a downstream wall of the first stay 210. The base 211 also has a downstream surface Fa and upstream surface Fb opposite each other in the moving direction. The downstream surface Fa is positioned downstream in the moving direction, while the upstream surface Fb is positioned upstream in the moving direction.

The hem-bent portion HB is a portion bent by hemming. The hem-bent portion HB extends from one end of the base 211 (opposite the contact face Ft) in the predetermined direction, and is bent toward the holder 140. Specifically, the hem-bent portion HB includes a bent portion 212 and an upstream wall 213. The bent portion 212 is a portion extending from the one end of the base 211 in the predetermined direction. The upstream wall 213 extends from the bent portion 212 toward the holder body 141. The upstream wall 213 is in parallel to the base 211 and is disposed upstream of the base 211 (downstream wall) in the moving direction. The upstream wall 213 and the base 211 face each other in the moving direction with a gap therebetween, the gap being smaller than a thickness of the first stay 210.

The hem-bent portion HB has a length in the widthwise direction smaller than that of the base 211. Hence, both widthwise end portions of the base 211 are disposed farther outward than widthwise end portions of the hem-bent portion HB in the widthwise direction, respectively.

Each widthwise end portion of the base 211 is formed with a load receiving part 211A for receiving load applied from the pressure varying mechanism 300 (see FIG. 4) described later. Each load receiving part 211A is a recess that is open in a direction away from the nip-forming member N, i.e., in a direction opposite the predetermined direction. The load receiving parts 211A are formed in an edge of the base 211, the edge being farther away from the nip-forming member N than an edge having the contact face Ft in the predetermined direction.

A buffer member BF made of resin is fitted with each load receiving part 211A. The buffer members BF are configured to prevent the metal base 211 from rubbing with respective arms 310 made of metal (see FIG. 4) described later. Each buffer member BF includes a fitting portion BF1 and a pair of leg portions BF2. The fitting portion BF1 is fitted in the corresponding load receiving part 211A, and the leg portions BF2 are positioned to interpose the corresponding widthwise end portion of the base 211 therebetween in the moving direction. That is, the leg portions BF2 are respectively positioned upstream and downstream in the moving direction relative to the corresponding widthwise end portion of the base 211.

The second stay 220 supports the holder body 141 of the holder 140. The second stay 220 is made of metal. The second stay 220 is positioned upstream of the first stay 210 in the moving direction. The second stay 220 includes a base 221 and an extension portion 222. The base 221 is disposed in parallel to the upstream wall 213 of the first stay 210. The extension portion 222 extends toward the first stay 21 from an edge of the base 221 away from the nip-forming member N in the predetermined direction.

The base 221 has a length in the widthwise direction greater than a length in the widthwise direction of the extension portion 222 and the length in the widthwise direction of the hem-bent portion HB of the first stay 210. Both widthwise end portions of the base 221 are disposed farther outward in the widthwise direction than widthwise end portions of the extension portion 222 and the widthwise end portions of the hem-bent portion HB. Each widthwise end portion of the base 211 of the first stay 210 and the corresponding widthwise end portion of the base 221 of the second stay 220 are connected to each other by a connecting member CM. That is, the connecting members CM are coupled to the base 211 at different positions from the hem-bent portion HB in the widthwise direction.

The belt guide G is configured to guide the inner peripheral surface 131 of the belt 130. The belt guide G is made of heat-resistant resin. The belt guide G includes an upstream guide G1 and a downstream guide G2.

The sliding sheet 150 is a rectangular-shaped sheet provided for reducing friction resistance between the belt 130 and each of the pads P1 and P2. The sliding sheet 150 is interposed between the inner peripheral surface 131 of the belt 130 and each of the pads P1 and P2 at the nip region NP. The sliding sheet 150 is made of an elastically deformable material. Incidentally, the sliding sheet 150 may be made of any material. In this embodiment, the sliding sheet 150 is made of resin containing polyimide.

As illustrated in FIG. 2, the upstream guide G1, the downstream guide G2, and the first stay 210 are fastened together with screws SC. Specifically, the upstream guide G1 includes bosses G13 protruding toward downstream in the moving direction. The downstream guide G2 includes fixing portions G22.

The bosses G13 function to fix the upstream guide G1 and the downstream guide G2 to the first stay 210. As illustrated in FIG. 3, the bosses G13 are made in contact with the base 211 of the first stay 210 through corresponding through-holes Hc1, Hc2, and Hc3 formed in the sliding sheet 150, the second stay 220, and the upstream wall 213 of the first stay 210, respectively. The screws SC are screwed into protruding ends of the respective bosses G13 through through-holes Hc5 formed in the fixing portions G22 (see FIG. 3) and through-holes (not illustrated) formed in the base 211 of the first stay 210. The fixing portions G22 are thus in contact with screw heads of the screws SC.

Figure 4:
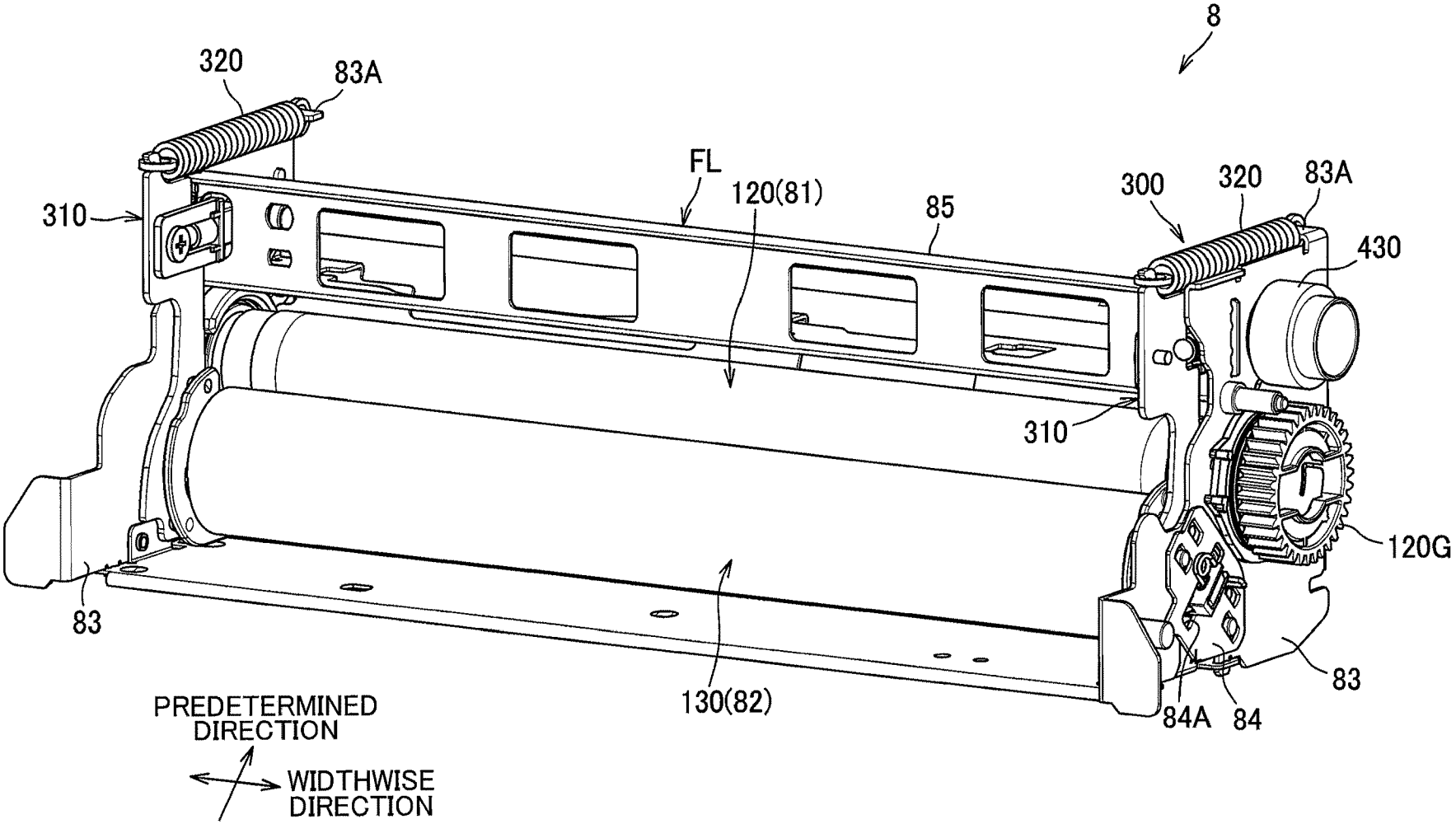
FIG. 4 is a perspective view illustrating a pressure varying mechanism of the fixing device according to the embodiment.

As illustrated in FIG. 4, the fixing device 8 further includes a frame FL and the pressure varying mechanism 300. The frame FL is made of metal and supports the heating unit 81 and the pressure unit 82. The frame FL includes the pair of side frames 83, a pair of brackets 84, and a connecting frame 85. The side frames 83 are respectively positioned outward of the heating unit 81 and the pressure unit 82 in the widthwise direction. The brackets 84 are respectively positioned outward of the heating unit 81 and the pressure unit 82 in the widthwise direction. The connecting frame 85 connects the both side frames 83.

The side frames 83 support the heating unit 81 and the pressure unit 82. Each side frame 83 has a spring engagement portion 83A for engagement with one end of a corresponding first spring 320 as described below.

The brackets 84 support the pressure unit 82 such that the pressure unit 82 is movable in the predetermined direction and in the direction opposite the predetermined direction. The brackets 84 are fixed to the respective side frames 83. Specifically, each bracket 84 has a first elongated hole 84A elongated in the predetermined direction. Through the first elongated holes 84A, the brackets 84 movably support the respective widthwise end portions of the first stay 210 via the engagement portions 143, 142 of the holder 140 so that the first stay 210 is movable in the predetermined direction and in the direction opposite the predetermined direction.

The pressure varying mechanism 300 is configured to vary nip pressure applied to the nip region NP. The pressure varying mechanism 300 includes the pair of arms 310, a pair of first springs 320, a pair of second springs 330, and a pair of cams 340. The arms 310, the first springs 320, the second springs 330, and the cams 340 are disposed one each on each widthwise end portion of the frame FL in the widthwise direction.

The arms 310 are configured to press the first stay 210 via the respective buffer members BF. The arms 310 support the pressure unit 82. Each arm 310 is pivotably supported relative to the corresponding side frame 83.

Specifically, each arm 310 has an arm body 311, and a cam follower 350. The arm body 311 is a flat plate-like member having an L-shape. The arm body 311 is made of metal, for example.

The arm body 311 has a first end portion 311A, a second end portion 311B, and an engagement hole portion 311C. The first end portion 311A is pivotably supported by the corresponding side frame 83. The second end portion 311B is coupled with the one end of the corresponding first spring 320. The engagement hole portion 311C supports the corresponding widthwise end portion of the pressure unit 82. The engagement hole portion 311C is positioned between the first end portion 311A and the second end portion 311B in the predetermined direction. The engagement hole portion 311C is engaged with the corresponding buffer member BF.

Each arm body 311 further includes a guide protrusion 312 extending toward the corresponding cam 340. The guide protrusion 312 is positioned between the second end portion 311B and the engagement hole portion 311C in a direction from the engagement hole portion 311C toward the engagement hole portion 311C.

The cam follower 350 is movably supported by the guide protrusion 312 of the arm body 311. The cam follower 350 is capable of contacting and separating from the cam 340 in accordance with movement of the cam follower 350 relative to the guide protrusion 312. The cam follower 350 is made of resin, for example. The cam follower 350 includes a cylindrical portion 351, a contact portion 352, and a flange portion 353. The cylindrical portion 351 is fitted over the guide protrusion 312 of the arm body 311. The contact portion 352 is disposed at one end portion of the cylindrical portion 351. The flange portion 353 is provided at another end portion of the cylindrical portion 351.

The cylindrical portion 351 is supported by the guide protrusion 312 so as to be movable in an extending direction of the guide protrusion 312 (hereinafter, will be referred to as a moving direction of the cam follower 350, wherever appropriate). The contact portion 352 is a wall that covers an opening formed in the one end portion of the cylindrical portion 351 adjacent to the cam 340. The contact portion 352 is disposed between the cam 340 and a protruding end of the guide protrusion 312. The flange portion 353 protrudes radially outward from the other end portion of the cylindrical portion 351, i.e., protrudes in a direction orthogonal to the moving direction of the cam follower 350.

Further, the second spring 330 is disposed between the cylindrical portion 351 and the arm body 311. In this way, each arm body 311 is urged by the corresponding first spring 320 and second spring 330.

The first spring 320 is configured to apply first urging force to the pressure unit 82. Specifically, the first spring 320 is configured to apply the first urging force to the pressure unit 82 via the corresponding arm body 311.

More specifically, the first spring 320 is a coil spring configured to urge the upstream pad P1 and the downstream pad P2 toward the rotary body 120 via the corresponding arm body 311, the corresponding buffer member BF, the first stay 210, and the holder 140. The first spring 320 is a tension spring made of metal. The first spring 320 has one end coupled to the spring engagement portion 83A of the corresponding side frame 83. The first spring 320 has another end coupled to the second end portion 311B of the corresponding arm body 311.

The second spring 330 is configured to apply second urging force to the pressure unit 82, the second urging force being opposite to the first urging force. Specifically, the second spring 330 is configured to apply the second urging force to the pressure unit 82 via the corresponding arm body 311. The second spring 330 is a compressed coil spring made of metal, for example. The second spring 330 is disposed between the cylindrical portion 351 and the arm body 311 in a compressed state such that the guide protrusion 312 extends through an internal space of the second spring 330.

The cam 340 is configured to shift a state of the second spring 330 among a first compression state, a second compression state, and a third compression state. In the first compression state, the second urging force is not applied to the pressure unit 82. In the second compression state, the second urging force is applied to the pressure unit 82. In the third compression state, the second spring 330 is more deformed (more compressed) than in the second compression state. The cam 340 is supported by the corresponding side frame 83 such that the cam 340 is pivotable among a first cam position illustrated in FIG. 5A, a second cam position illustrated in FIG. 6A, and a third cam position illustrated in FIG. 7A.

The cam 340 is made of resin, for example. The cam 340 includes a first portion 341, a second portion 342, and a third portion 343. The first portion 341, the second portion 342, and the third portion 343 are all positioned on an outer circumferential surface of the cam 340.

Figure 5A:
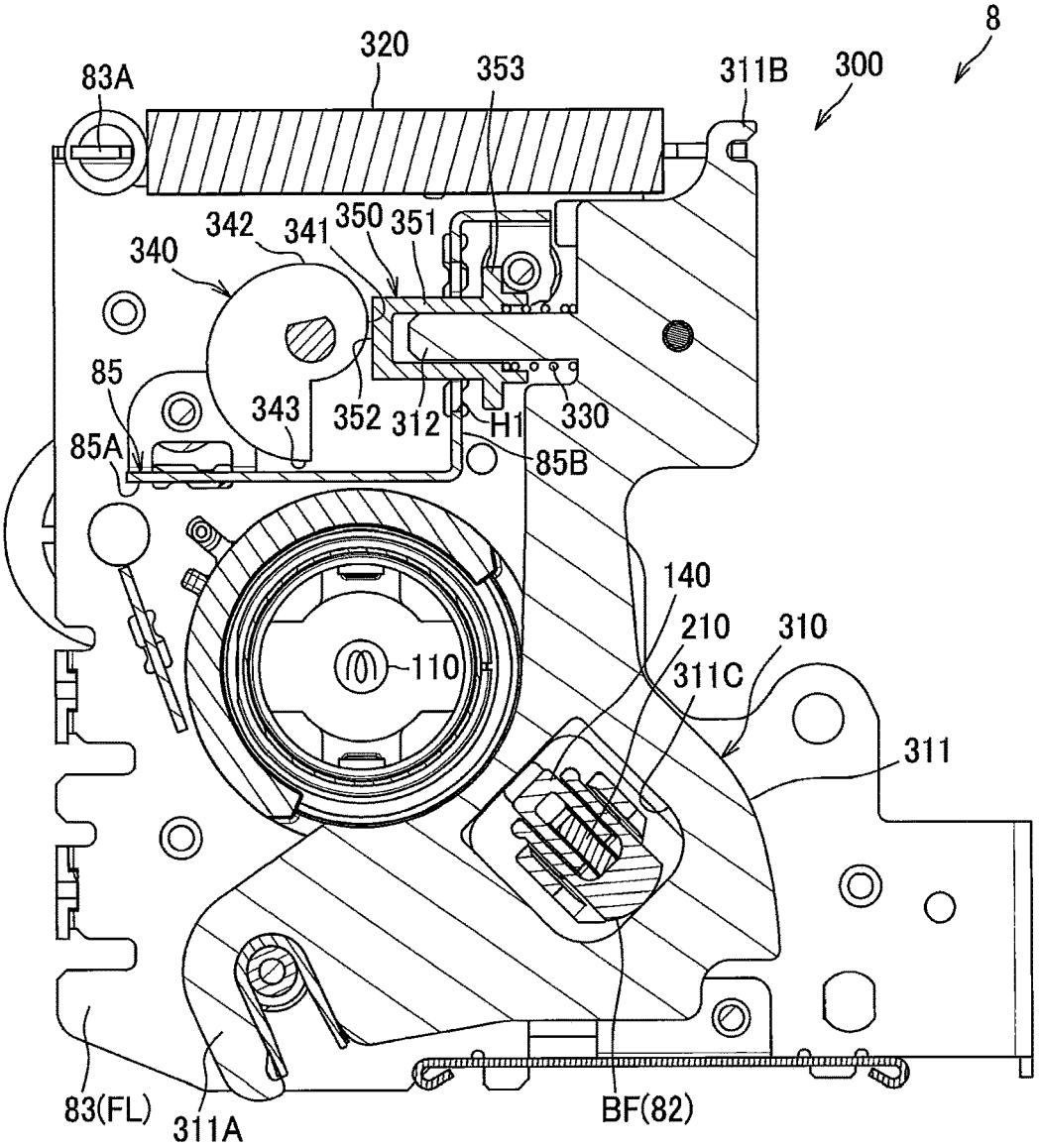
FIG. 5A is a schematic cross-sectional view of the pressure varying mechanism in a state where a first nip pressure is applied to a nip region.

The first portion 341 is a portion located closest to the cam follower 350 when the cam 340 is at the first cam position. As illustrated in FIG. 5A, the first portion 341 is in separation from the cam follower 350 when the cam 340 is at the first cam position.

Figure 6A:
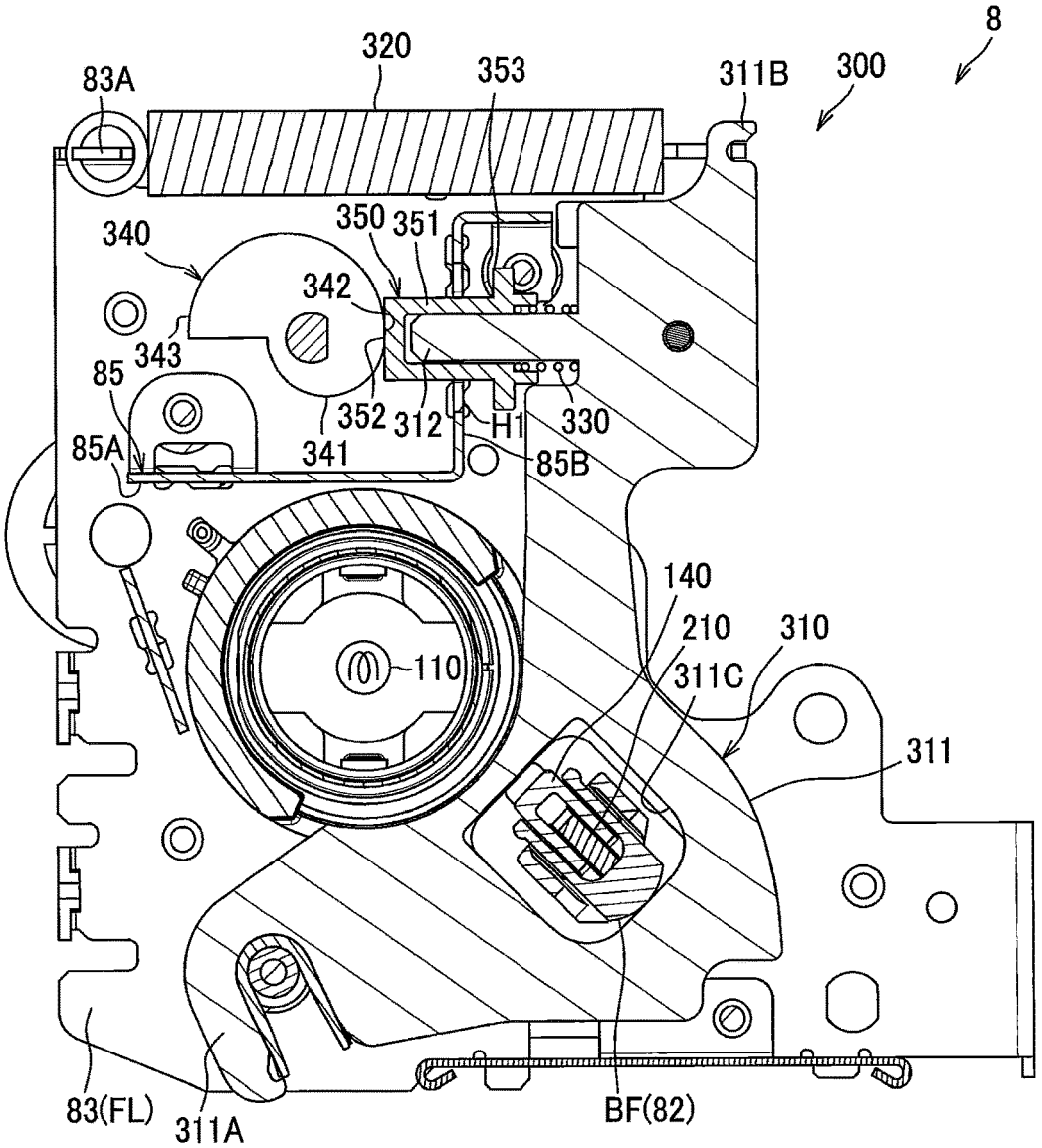
FIG. 6A is a schematic cross-sectional view of the pressure varying mechanism in a state where a second nip pressure is applied to the nip region.

The second portion 342 is a portion that comes into contact with the cam follower 350 when the cam 340 is at the second cam position. Specifically, as illustrated in FIG. 6A, the second portion 342 is in contact with the cam follower 350 when the cam 340 is pivoted clockwise from the first cam position by approximately 90 degrees. The second portion 342 and a pivot center of the cam 340 define a distance therebetween that is larger than a distance between the first portion 341 and the pivot center of the cam 340.

Figure 7A:
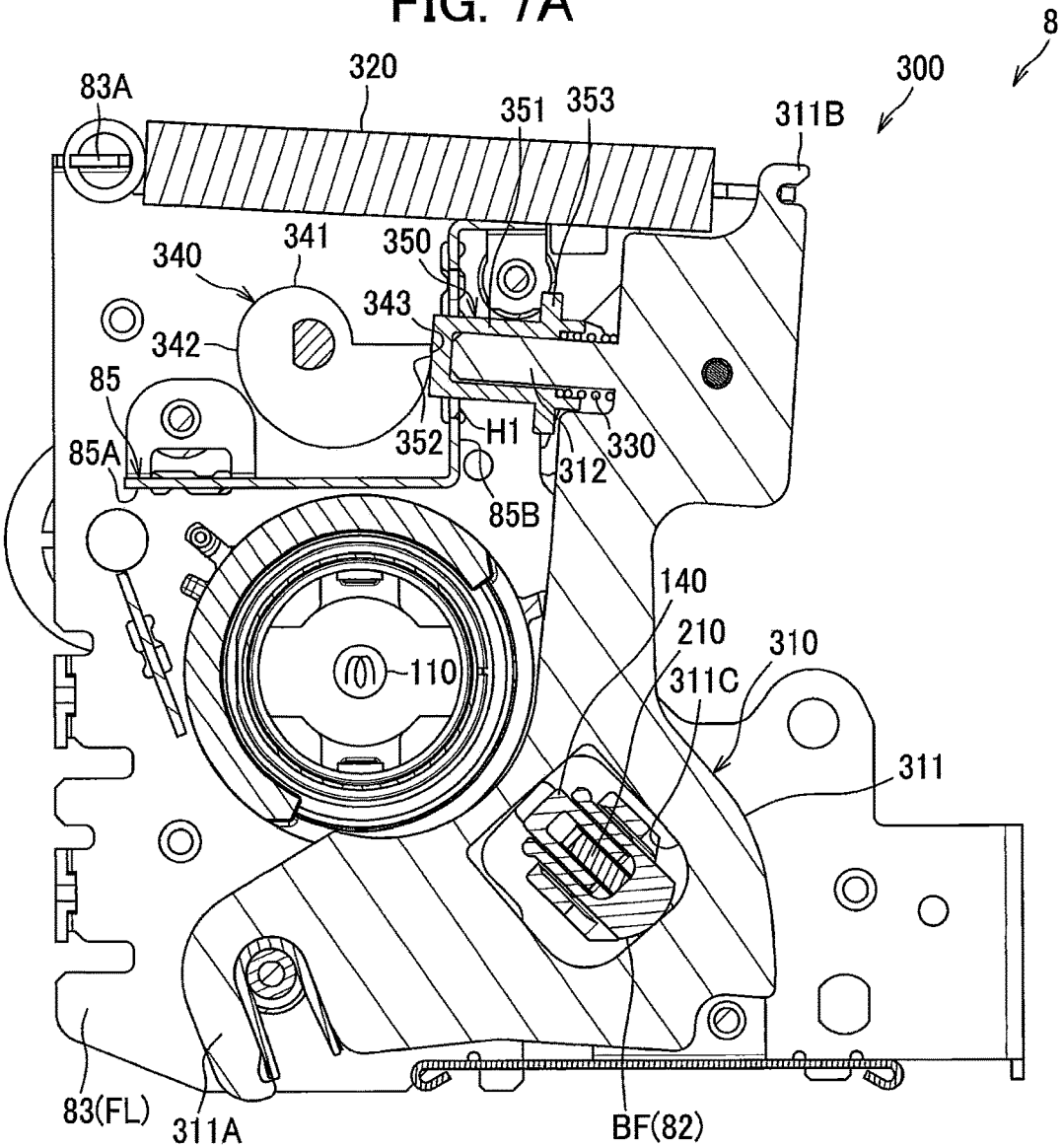
FIG. 7A is a schematic cross-sectional view of the pressure varying mechanism in a state where a third nip pressure is applied to the nip region.

The third portion 343 is a portion that comes into contact with the cam follower 350 when the cam 340 is at the third cam position. Specifically, as illustrated in FIG. 7A, the third portion 343 comes into contact with the cam follower 350 when the cam 340 pivots clockwise from the first cam position by approximately 270 degrees, or from the second cam position by approximately 180 degrees. The third portion 343 and the pivot center of the cam 340 define a distance between that is greater than the distance between the second portion 342 and the pivot center of the cam 340.

When the cam 340 is at the first cam position, the cam 340 is separated away from the cam follower 350, thereby brining the second spring 330 into the first compression state. While the second spring 330 is maintained in the first compression state by the cam 340, the arm body 311 is in a first posture illustrated in FIG. 5A.

Specifically, while the cam 340 maintains the second spring 330 at the first compression state, the cam 340 is spaced away from the cam follower 350. Hence, the second urging force of the second spring 330 is not applied to the pressure unit 82 through the arm body 311, but only the first urging force of the first spring 320 is applied to the pressure unit 82 via the arm body 311. Hereinafter, the nip pressure in this state (the pressure unit 82 is applied with the first urging force from the first spring 320, but is not applied with the second urging force from the second spring 330) will be referred to as "first nip pressure."

Incidentally, in the present embodiment, the second spring 330 is disposed between the cam follower 350 and the arm body 311 in a deformed state when the cam 340 maintains the second spring 330 at the first compression state. That is, in the present embodiment, in the first compression state, the second spring 330 has a length that is not a natural length thereof, i.e., the second spring 330 is deformed (compressed) from a state having the natural length. Note that, even when the second spring 330 is deformed in the first compression state, the second urging force of the second spring 330 is not applied to the pressure unit 82 because the cam 340 is separated from the cam follower 350.

When the cam 340 pivots from the first cam position illustrated in FIG. 5A to the second cam position illustrated in FIG. 6A, the cam 340 comes into contact with the cam follower 350 to move the cam follower 350 by a predetermined distance relative to the arm body 311. In this way, when the cam 340 is at the second cam position, the second spring 330 is brought into the second compression state where the second spring 330 is more deformed (compressed) than in the first compression state.

While the cam 340 is at the second cam position, the cam 340 supports the cam follower 350 so that the second urging force of the second spring 330 is applied to the pressure unit 82 via the arm body 311 in a direction opposite to that of the first urging force. Thus, in a state where the first spring 320 applies the first urging force to the pressure unit 82 and the second spring 330 applies the second urging force to the pressure unit 82, the nip pressure is reduced to "second nip pressure" that is smaller than the first nip pressure.

Incidentally, while the cam 340 keeps the second spring 330 in the second compression state, the arm body 311 remains in the first posture described above. Here, in a state where the downstream pad P2 is pressed against the rotary body 120 (i.e., the downstream pad P2 is applied with a load), the downstream pad P2 undergoes substantially no deformation, regardless of the intensity of the load. Accordingly, since the downstream pad P2 undergoes substantially no deformation, the posture of the stay 200 supporting the downstream pad P2 and the posture of the arm 310 supporting the stay 200 are both maintained substantially unchanged (constant) regardless of the intensity of the load.

In this state where there is substantially no deformation of the downstream pad P2 and the downstream pad P2 is substantially fixed in position, the upstream pad P1 is also maintained at a substantially fixed position since the position of the upstream pad P1 is determined in accordance with the position of the downstream pad P2. Accordingly, regardless of the nip pressure being the first nip pressure (tight nip) or the second nip pressure (weak nip), an entire width of the nip region NP (a length of the nip region NP from an inlet of upstream nip region NP1 to an outlet of the downstream nip region NP2) remains substantially constant, and the arm 310 is maintained substantially at the same posture, i.e., in the first posture.

Note that deformation of the downstream pad P2 does not occur, because the hardness of the downstream pad P2 is significantly higher than those of the upstream pad P1 and the elastic layer 122 of the rotary body 120. More specifically, the downstream pad P2 has such a hardness that would not cause deformation of the downstream pad P2 as long as the nip pressure required at the downstream nip region NP2 is within a prescribed range, i.e., from a maximum nip pressure (downstream nip pressure during the tight nip) to a minimum nip pressure (downstream nip pressure during the weak nip).

In other words, the maximum nip pressure and the minimum nip pressure required at the downstream nip region NP2 are set to such values that would cause substantially no deformation of the downstream pad P2.

Here, the phrase "the downstream pad P2 undergoes substantially no deformation" intends to include a state where the downstream pad P2 indeed deforms to such a degree that resultant variation in a width of the nip at the downstream nip region NP2 (length and position of the nip in the moving direction of the belt) would not affect image quality and conveyance of the sheet S. In other words, the variation in the width of the nip at the downstream nip region NP2 is not necessarily to be zero.

Figure 5B:
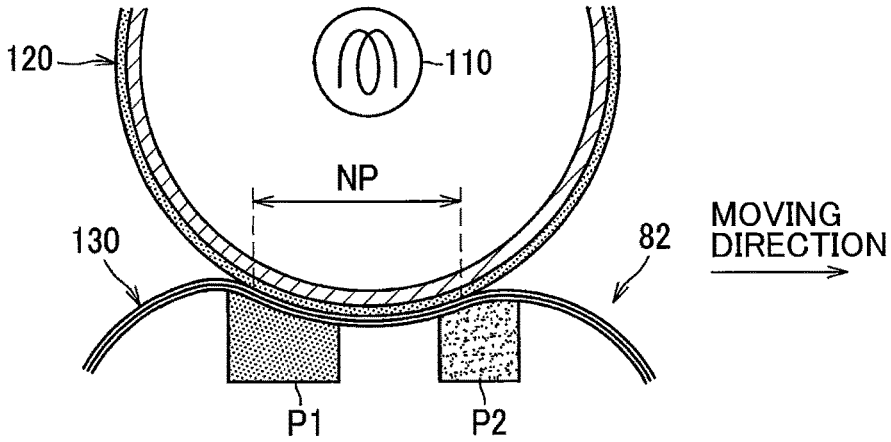
FIG. 5B is a cross-sectional view illustrating a structure near the nip region in the state where the first nip pressure is applied to the nip region.
Figure 6B:
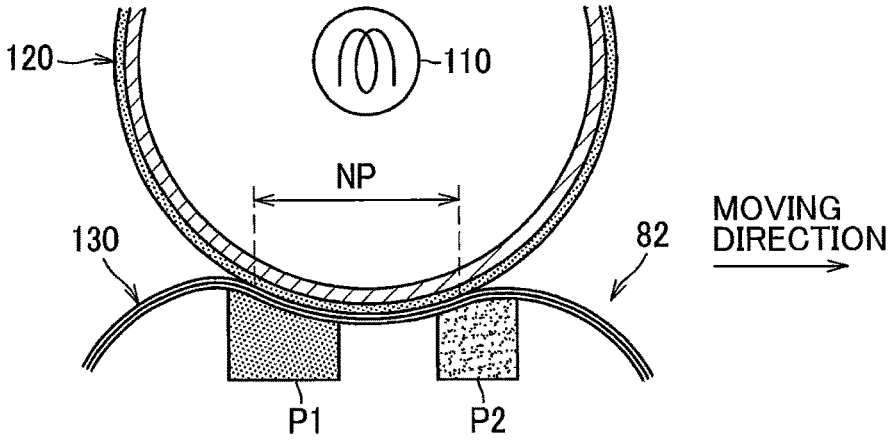
FIG. 6B is a cross-sectional view illustrating the structure near the nip region in the state where the second nip pressure is applied to the nip region.

As described above, the arm body 311 is kept in the first posture while the second spring 330 is either in the first compression state or in the second compression state. Thus, the belt 130 is held between the rotary body 120 and each of the pads P1 and P2 as long as the nip pressure at the nip region NP is either the first nip pressure or the second nip pressure, as illustrated in FIGS. 5B and 6B. Specifically, the position of the pressure unit 82 relative to the rotary body 120 is substantially the same, regardless of the nip pressure being the first nip pressure or the second nip pressure, and, hence, the width of the nip region NP (the length of the nip region NP in the moving direction of the belt 130) is substantially constant while the nip pressure at the nip region NP is the first nip pressure or the second nip pressure.

When the cam 340 pivots from the second cam position illustrated in FIG. 6A to the third cam position illustrated in FIG. 7A, the cam 340 moves the cam follower 350 further relative to the arm body 311, thereby pressing the arm body 311 through the cam follower 350. By being pressed by the cam 340 through cam follower 350, the second spring 330 is further deformed (compressed) into the third compression state from the second compression state, and the arm body 311 is pivoted from the first posture to a second posture (illustrated in FIG. 7A) different from the first posture.

Specifically, during pivoting of the cam 340 from the second cam position to the third cam position, the cam follower 350 initially moves relative to the arm body 311 such that the contact portion 352 of the cam follower 350 approaches the protruding end of the guide protrusion 312. Upon abutment of the contact portion 352 against the protruding end of the guide protrusion 312, the second spring 330 is rendered into the third compression state. While the cam 340 holds the second spring 330 at the third compression state, the contact portion 352, which is a portion of the cam follower 350, is interposed between the cam 340 and the guide protrusion 312. In other words, the contact portion 352 is in contact with each of the cam 340 and the guide protrusion 312. As the cam 340 is further pivoted, the cam 340 presses the guide protrusion 312 via the contact portion 352. As a result, the arm body 311 is pivoted from the first posture to the second posture against the first urging force of the first spring 320.

Figure 7B:
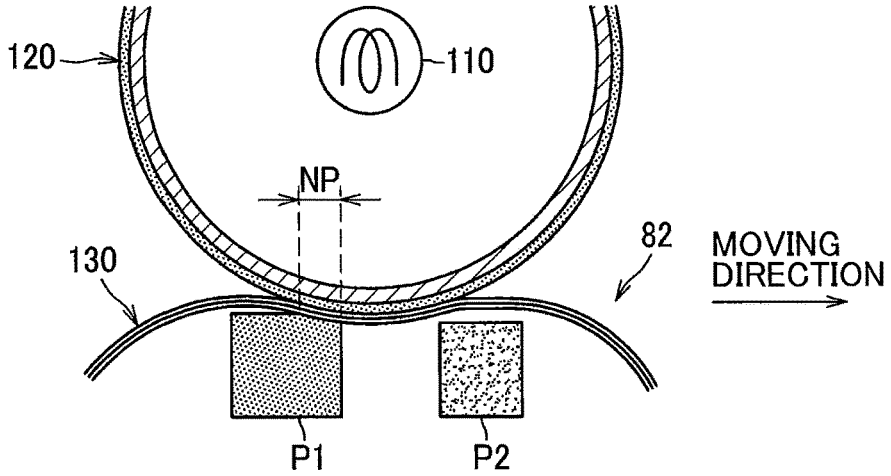
FIG. 7B is a cross-sectional view illustrating the structure near the nip region in the state where the third nip pressure is applied to the nip region.

While the arm body 311 is in the second posture, the pressure unit 82 is disposed at a position farther away from the rotary body 120 (see FIG. 7B) than while in the first posture (illustrated in FIG. 6B). Due to the change in position of the pressure unit 82 relative to the rotary body 120, as illustrated in FIG. 7B, the width of the nip region NP becomes smaller in the second posture than in the first posture, and the nip pressure at the nip region NP is reduced to a third nip pressure from the second nip pressure. That is, the change in the posture of the arm 310 caused by the cam 340 changes the nip pressure and the nip width at the nip region NP.

Specifically, while the arm 310 is in the second posture, the belt 130 is nipped only between the upstream pad P1 and the rotary body 120, not between the downstream pad P2 and the rotary body 120. As a result, while the arm 310 is in the second posture, the nip pressure and the width of the nip at the upstream nip region NP1 are made smaller than those in the first posture, and the nip pressure at a region corresponding to the downstream nip region NP2 becomes zero.

Incidentally, in the present embodiment, the belt 130 is nipped between the upstream pad P1 and the rotary body 120 while the nip pressure is the third nip pressure. However, contrary to the present embodiment, the belt 130 may not be held between the upstream pad P1 and the rotary body 120 under the third nip pressure. If this is the case, the third nip pressure is to be zero.

The connecting frame 85 includes a first wall 85A and a second wall 85B. As illustrated in FIGS. 6A, 7A, 8A and 9, the first wall 85A is disposed between each cam 340 and the heater 110 generally in the predetermined direction.

The second wall 85B extends from one edge of the first wall 85A toward the first springs 320. The second wall 85B is formed with through-holes H1 through each of which the cylindrical portion 351 of the corresponding cam follower 350 penetrates.

Figure 8A:
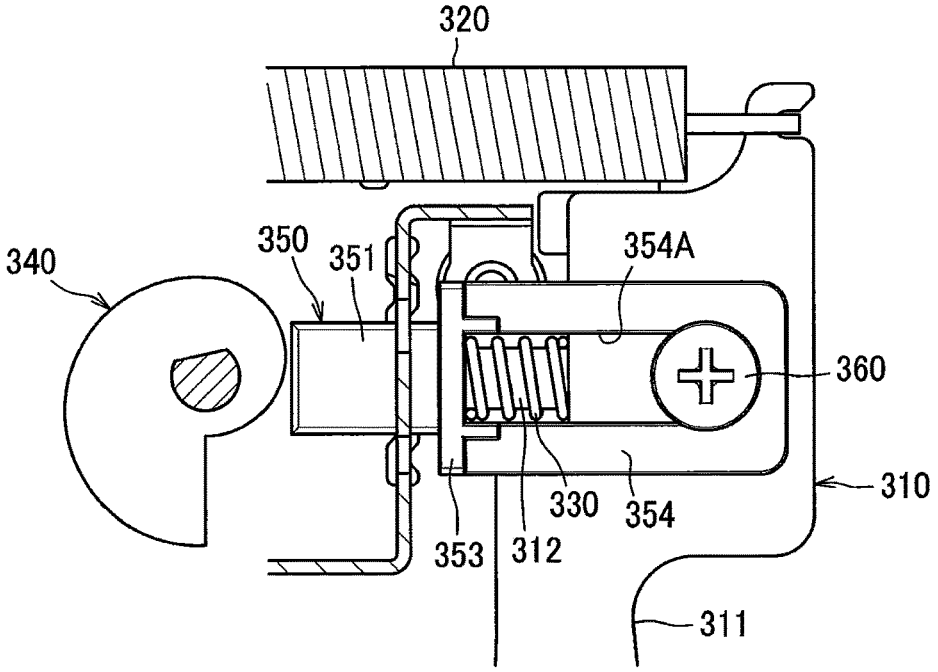
FIG. 8A is a view illustrating a cam follower in relation to a screw in the fixing device according to the embodiment.
Figure 8B:
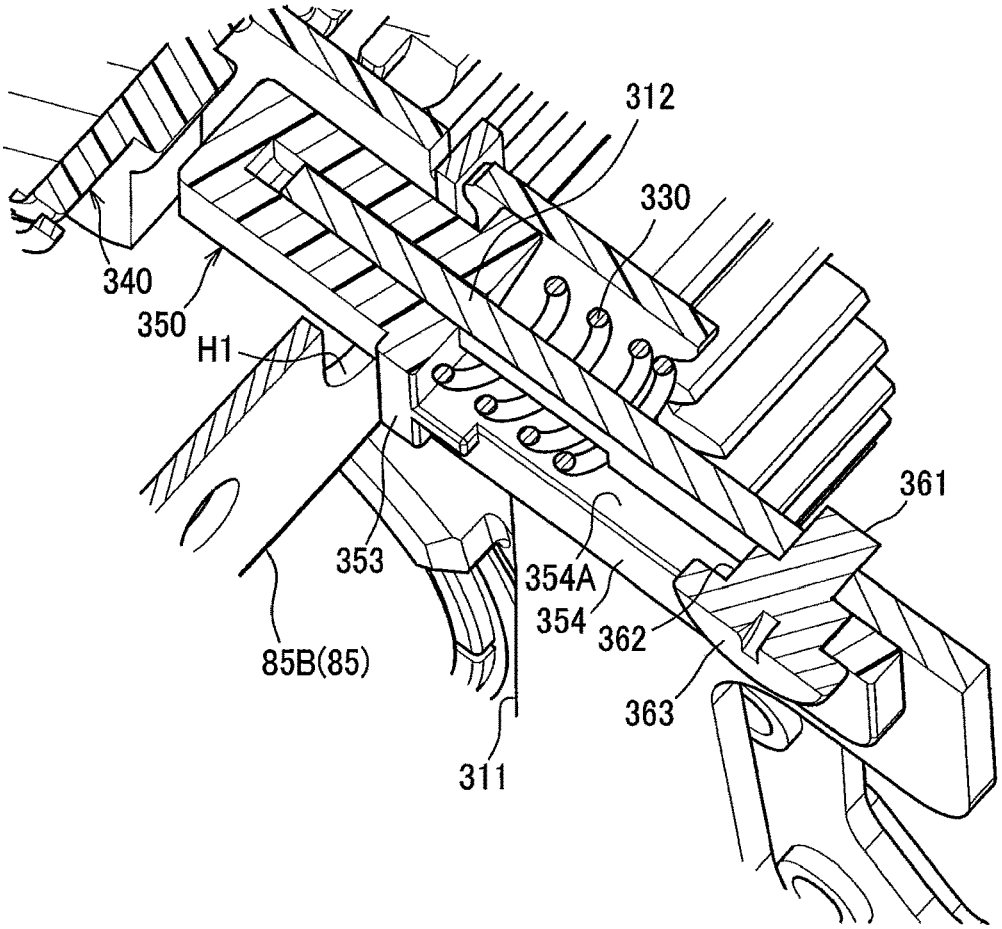
FIG. 8B is a partially-enlarged perspective view schematically illustrating the cam follower, a second spring and an arm body in the fixing device according to the embodiment.

As illustrated in FIGS. 8A and 8B, a screw 360 is further threaded in each arm 310. The screw 360 is made of metal and has a stepped shape. The screw 360 is configured to restrict the cam follower 350 from moving toward the cam 340. The screw 360 includes a screw shaft 361, a large-diameter portion 362, and a screw head 363. The screw shaft 361 has an outer circumferential surface formed with thread grooves. The large-diameter portion 362 has a larger diameter than the screw shaft 361. The screw head 363 has a diameter larger than the diameter of the large-diameter portion 362. The large-diameter portion 362 is positioned between the screw shaft 361 and the screw head 363. The screw 360 is screw-fixed to each arm body 311 such that the large-diameter portion 362 is in contact with a side surface of the arm body 311.

The cam follower 350 further includes an extending portion 354. The extending portion 354 extends from the flange portion 353 in a direction away from the contact portion 352 toward the screw 360. The extending portion 354 has an elongated hole 354A for engagement with the large-diameter portion 362 of the screw 360. The extending portion 354 is slidable along the side surface of the arm body 311.

The elongated hole 354A extends in the extending direction of the guide protrusion 312. The elongated hole 354A has an edge engageable with the large-diameter portion 362, the edge being closer to the screw 360. With the engagement of the large-diameter portion 362 with the edge of the elongated hole 354A, the screw 360 can restricts the screw 360 from moving toward the cam 340.

The extending portion 354 is held between the screw head 363 of the screw 360 and the arm body 311. In this way, the cam follower 350 is movably supported with respect to the arm body 311 without being detached from the arm body 311.

Figure 9:
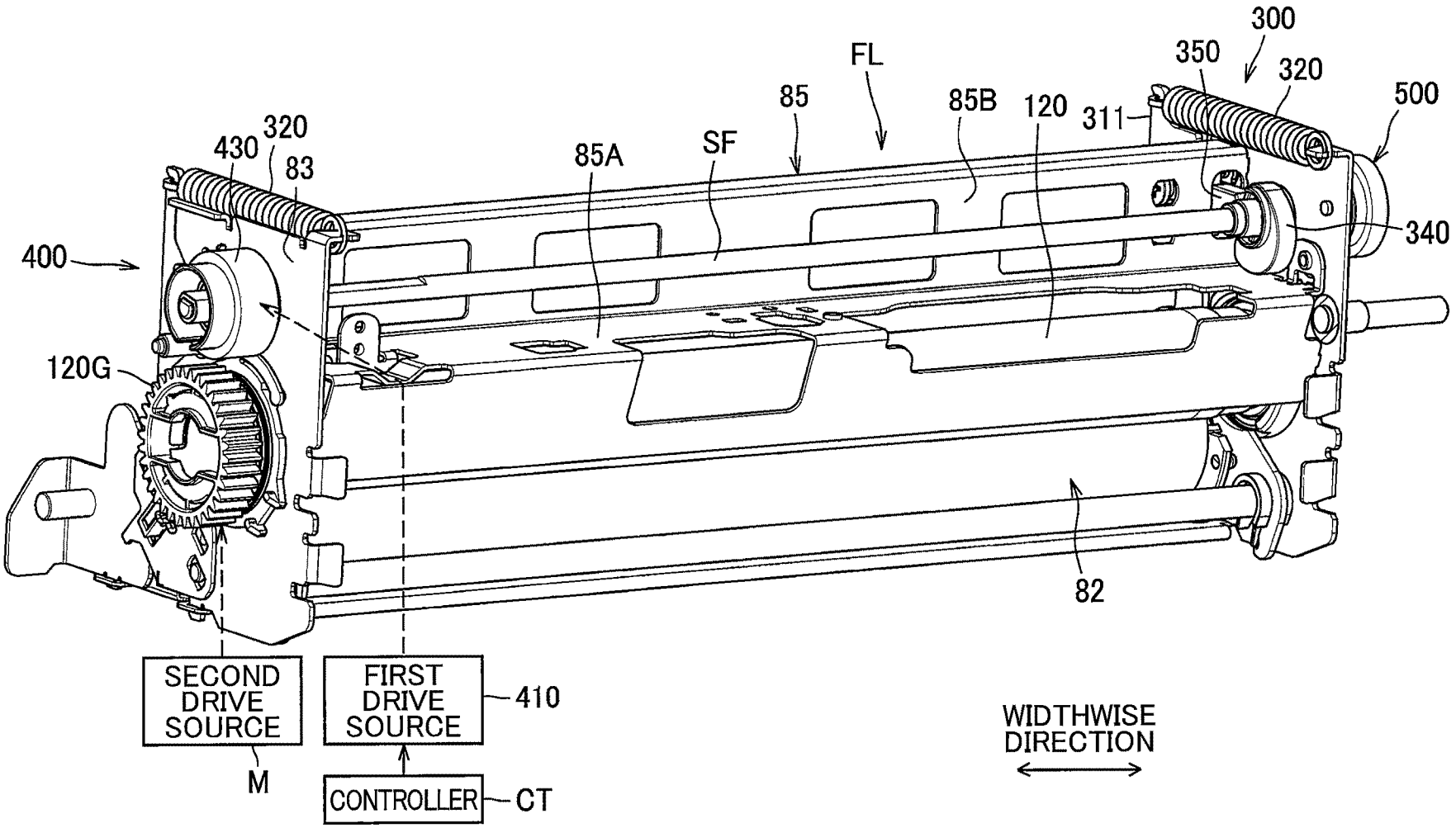
FIG. 9 is a perspective view mainly illustrating a cam drive mechanism in the fixing device according to the embodiment.

As illustrated in FIG. 9, the pressure varying mechanism 300 further includes a metal shaft SF, a cam drive mechanism 400, and a braking mechanism 500. The shaft SF extends in the widthwise direction to connect the two cams 340 (only one of which is illustrated) provided at the respective end portions of the frame FL in the widthwise direction. More specifically, the shaft SF is rotatably supported by the frame FL, and each of the cams 340 is fixed to each widthwise end portion of the shaft SF. That is, the cams 340 are supported by the frame FL through the shaft SF. The shaft SF is provided coaxially with the pivot centers of the respective cams 340 so as to be rotatable together with the cams 340. The shaft SF has one end connected to the cam drive mechanism 400, and another end connected to the braking mechanism 500.

The cam drive mechanism 400 includes a first drive source 410 and a cam drive gear 430. The first drive source 410 is a motor rotatable in forward and reverse directions. The first drive source 410 is disposed on the main casing 2. The first drive source 410 is under control of a controller CT. A driving force of the first drive source 410 is configured to be inputted into the cam drive gear 430 via gears (not illustrated) disposed in the main casing 2 and the corresponding side frame 83.

The cam drive gear 430 is made of resin. The cam drive gear 430 is disposed on an outer side surface of the corresponding side frame 83 in the widthwise direction. In other words, the cam drive gear 430 is positioned opposite to the cam 340 with respect to the side frame 83.

The cam drive gear 430 is rotatably supported by the corresponding side frame 83. The cam drive gear 430 is fixed to the one end of the shaft SF so as to be rotatable together with the shaft SF and the cams 340.

The cam drive mechanism 400 having the above-described configuration is configured to cause pivotal movement of the cams 340 in a first prescribed direction (specifically, in the clockwise direction in the drawings), to shift the compression state of the second springs 330 sequentially from the first compression state, the second compression state, and the third compression state, in this order, as illustrated in FIGS. 5A, 6A, and 7A, respectively. The cam drive mechanism 400 can also cause the cams 340 to pivot in a second prescribed direction opposite the first prescribed direction (specifically, the counterclockwise direction in the drawings) to shift the compression state of the second springs 330 sequentially from the third compression state, the second compression state, and the first compression state, in this order, as illustrated in FIGS. 7A, 6A, and 5A, respectively.

Referring back to FIG. 9, the side frame 83 supporting the cam drive gear 430 is also provided with a drive gear 120G for driving the rotary body 120. The drive gear 120G is disposed at one end of the rotary body 120 in the axial direction. The drive gear 120G is coaxial with the rotary body 120 and is rotatable together with the rotary body 120. The drive gear 120G is configured to receive a driving force from a second drive source M different from the first drive source 410.

The braking mechanism 500 is configured to apply a resisting force to the corresponding cam 340 in a case where the cam 340 is prompted to rotate in the second prescribed direction (the counterclockwise direction in FIG. 5A). Specifically, the braking mechanism 500 is configured to apply greater resisting force to the cam 340 while the cam 340 rotates in the second prescribed direction than while the cam 340 rotates in the first prescribed direction (the clockwise direction in FIG. 5). The braking mechanism 500 is disposed at the other end of the rotary body 120 in the axial direction. The braking mechanism 500 is disposed opposite to the rotary body 120, specifically the heater 110, with respect to the side frame 83.

Figure 10:
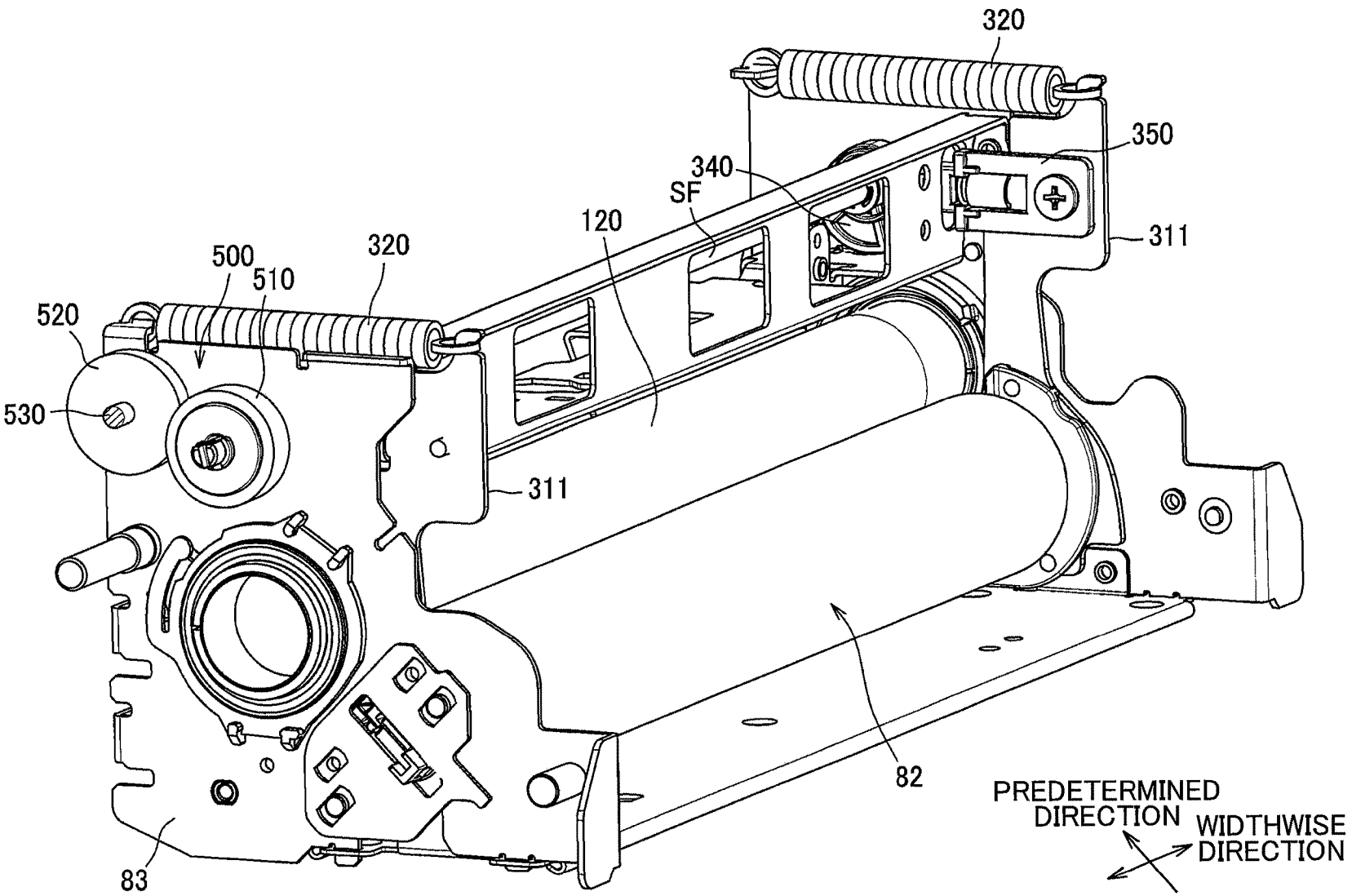
FIG. 10 is a perspective view mainly illustrating a braking mechanism in the fixing device according to the embodiment.
Figure 11:
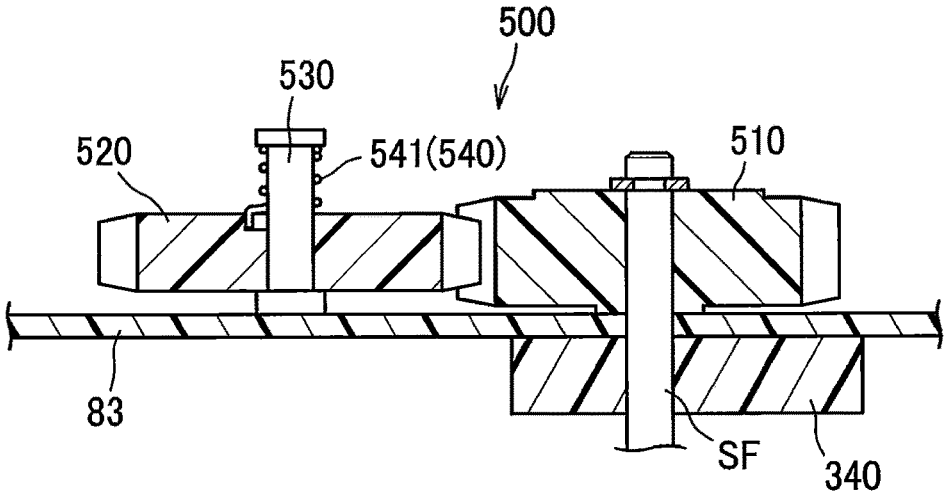
FIG. 11 is a horizontal cross-sectional view of the braking mechanism in the fixing device according to the embodiment.

As illustrated in FIGS. 10 and 11, the braking mechanism 500 includes a first gear 510, a second gear 520, a shaft 530, and a spring clutch 540. The first gear 510 is disposed coaxially with the respective cams 340. The first gear 510 is rotatable together with the cams 340. The first gear 510 is fixed to the other end of the shaft SF. The first gear 510 and the second gear 520 are made of resin, for example. The shaft 530 and the spring clutch 540 are made of metal, for example.

The second gear 520 is rotatable about the shaft 530. The second gear 520 is in meshing engagement with the first gear 510. The shaft 530 has a columnar shape and is fixed to the corresponding side frame 83. The shaft 530 rotatably supports the second gear 520.

The spring clutch 540 is a compressed coil spring. The spring clutch 540 has a coiled portion functioning as a tightening portion 541 wound over a peripheral surface of the shaft 530. The spring clutch 540 has one end portion fixed to the second gear 520, and another end portion is a free end fixed to nowhere.

The shaft 530 and the spring clutch 540 are rotatable relative to each other during the rotations of the cam 340. Specifically, as the cam 340 rotates, the spring clutch 540 is rotatable relative to the shaft 530.

When the cam 340 rotates in the second prescribed direction, the tightening portion 541 of the spring clutch 540 tightens the shaft 530 to apply the resisting force to the corresponding cam 340. That is, a winding direction (spiral direction) of the spring clutch 540 around the shaft 530 is determined so that such tightening force can be generated by the tightening portion 541. Note that, no such tightening force is generated by the tightening portion 541 as long as the cam 340 rotates in the first prescribed direction, to ensure smooth rotation of the cam 340.

<Operations of the Pressure Varying Mechanism 300>

The operations of the pressure varying mechanism 300 will now be described in detail.

As illustrated in FIG. 5A, in a state where the cam 340 is at the first cam position, the cam 340 is separated away from the corresponding cam follower 350. Thus, only the first urging force of the first spring 320 is applied to the pressure unit 82. As a result, the nip pressure at the nip region NP becomes the first nip pressure, and the width of the nip region NP becomes a predetermined width (see FIG. 5B). With the first nip pressure at the predetermined width of the nip region NP, a developer image can be satisfactorily thermally-fixed to a sheet S having a relatively small thickness, such as a plain sheet of paper.

When the cam 340 pivots from the first cam position to the second cam position, the cam 340 presses the cam follower 350 toward the arm body 311, as illustrated in FIG. 6A. At this time, since the arm body 311 does not move by force from the cam 340, the second spring 330 is compressed between the cam follower 350 and the arm body 311. The pressure unit 82 is thus applied with a force corresponding to the difference between the first urging force and the second urging force. The nip pressure at this time is the second nip pressure smaller than the first nip pressure, and the width of the nip region NP is maintained at the predetermined width (see FIG. 6B). With the second nip pressure at the predetermined width of the nip region NP, a developer image can be satisfactorily thermally-fixed to a sheet S whose thickness is greater than the thickness of a plain sheet of paper, such as a card board.

When the cam 340 pivots from the second cam position to the third cam position, the cam follower 350 pressed by the cam 340 moves toward the arm body 311, and the contact portion 352 of the cam follower 350 comes into contact with the protruding end of the guide protrusion 312, as illustrated in FIG. 7A. The cam 340 then presses the arm body 311 via the cam follower 350, causing the arm body 311 to pivot from the first posture to the second posture. As a result, the pressure unit 82 separates farther away from the rotary body 120 than in the first posture of the arm body 311, as illustrated in FIG. 7B, so that the nip pressure is declined to the third nip pressure smaller than the second nip pressure, and the width of the nip region NP becomes smaller than the predetermined width. This second posture of the arm body 311 (with the smaller nip width and the smaller nip pressure) is useful for addressing jamming of a sheet S between the rotary body 120 and the pressure unit 82.

As the cam 340 pivots in the second prescribed direction from the third cam position to the second cam position, the arm 310 is pivoted, while being supported by the cam 340, from the second posture (FIG. 7A) to the first posture (FIG. 6A) by the restoring force of the first spring 320. At this time, the second spring 330 comes back to the second compression state from the third compression state. That is, for shifting the second spring 330 from the third compression state to the second compression state, the cam 340 is applied with the restoring forces of the first spring 320 and the second spring 330 without receiving the driving force of the first drive source 410.

Here, for comparison, assume that the braking mechanism 500 illustrated in FIG. 11 is not provided. Without the braking mechanism 500, conceivably, the cam 340 may be pivoted more than necessary by the restoring forces of the first spring 320 and the second spring 330 since the driving force of the first drive source 410 is not inputted into the cam 340. Such pivoting of the cam 340 by the restoring forces may cause a rotation of the cam drive gear 430 (illustrated in FIG. 9) to fill in backlash between the cam drive gear 430 and a non-illustrated gear, which may result in generation of noise between the cam drive gear 430 and the non-illustrated gear.

However, in the present embodiment, the braking mechanism 500 illustrated in FIG. 11 is configured to apply a braking force to the cam 340 in a case where the cam 340 is prompted to pivot in the second prescribed direction. With this structure, the braking mechanism 500 can restrain the cam 340 from pivoting in the second prescribed direction by the restoring forces of the first spring 320 and the second spring 330.

When the cam 340 pivots from the second cam position to the first cam position, the second spring 330 returns to the first compression state (FIG. 5A) from the second compression state (FIG. 6A), while the arm 310 stays at the first posture. For shifting the second spring 330 from the second compression state to the first compression state, the cam 340 is applied with the restoring forces of the first spring 320 and the second spring 330, instead of the driving force of the first drive source 410. Since the braking force of the braking mechanism 500 acts on the corresponding cam 340 in the present embodiment as explained above, the cam 340 can be prevented from being pivoted excessively by the restoring force of the second spring 330.

Operational and Technical Advantages of the Embodiment

The structure of the depicted embodiment can obtain the following technical advantages.

The first nip pressure at the nip region NP is provided by the single first spring 320 in the present embodiment. This structure can suppress variation in the pressure distribution to provide the first nip pressure, compared to a conventional structure in which the first nip pressure is provided by two springs.

The one end of each first spring 320 is connected to the corresponding side frame 83 in the depicted embodiment. With this structure, the urging force of the first spring 320 can be efficiently transmitted to the pressure unit 82, compared to a structure in which one end of a first spring is connected to a frame via a separate member.

In the present embodiment, the urging forces of the first spring 320 and the second spring 330 are configured to be transmitted to the pressure unit 82 through the arm body 311. This structure can realize an enhanced degree of freedom in arrangement of the positions of the first spring 320 and the second spring 330, compared to a structure in which urging forces of first and second springs are directly transmitted to a pressure unit.

The cam 340 is provided for switching the compression state of the second spring 330 between the first compression state and the second compression state in the depicted embodiment. With this structure, switching as to whether the second urging force of the second spring 330 should be applied to the pressure unit 82 can be easily realized.

The second spring 330 is caused to deform by the cam follower 350 configured to contact the cam 340 in the present embodiment. With this structure, deformation of the second spring 330 can be realized readily, compared to a structure where deformation of the second spring is obtained by direct contact with a cam.

In the depicted embodiment, the second spring 330 is deformed in the first compression state. Compared to a structure where the second spring 330 in the first compression state has its natural length, variation in load attributed to manufacturing tolerance is less likely to occur. Further, compared to the structure where the second spring 330 in the first compression state has its natural length, an amount of movement of the cam follower 350 required for switching the nip pressure from the first nip pressure to the second nip pressure can be made smaller, even with a smaller spring constant.

While the second spring 330 is in the third compression state, the cam 340 can directly apply its force to the arm body 311 to realize pivoting of the arm body 311. That is, the nip pressure is switchable from the second nip pressure to the third nip pressure without application of the urging force of the second spring 330. This structure of the present embodiment can provide a reduced maximum load and a smaller amount of deformation for the second spring 330, compared to a structure where switching from the second nip pressure to the third nip pressure is realized by utilizing the urging force of the second spring.

The arm body 311 can be maintained at the same posture (first posture) regardless of whether the nip pressure is the first nip pressure or the second nip pressure. With this structure of the depicted embodiment, distribution in the nip pressure in a conveying direction of the sheet S is less likely to vary, compared to a structure where the posture of the arm body 311 is changeable according to whether the nip pressure is the first nip pressure or the second nip pressure. Hence, such little variation in the nip pressure distribution can restrain degradation in image quality and deterioration in transportability of the sheet S.

The cam follower 350 of the embodiment includes the cylindrical portion 351 fitted over the corresponding guide protrusion 312 and movably supported by the guide protrusion 312. With this structure, the guide protrusion 312 can restrict the cam follower 350 from moving in a direction orthogonal to the extending direction of the guiding protrusion 312.

The guide protrusion 312 of the arm body 311 is inserted in the internal space provided by a coiled portion of the corresponding second spring 330. This structure can restrict detachment of the second spring 330 from the corresponding arm body 311.

According to the depicted embodiment, the cam 340 is disposed between the second end portion 311B and the engagement hole portion 311C in the arm body 311. This structure can lead to downsizing of the cam 340 and the fixing device 8, compared to a structure where a cam is arranged, on an arm body, at a position farther away from an engagement hole portion than a second end portion is from the engagement hole portion.

The first wall 85A of the connecting frame 85 is disposed between each cam 340 and the heater 110. With this structure, the first wall 85A of the connecting frame 85 can curb transmission of heat from the heater 110 to the respective cams 340.

The braking mechanism 500 is configured to restrict the cams 340 from being rotated by the urging forces of the respective second springs 330 upon switching of the second springs 330 from the second compression state to the first compression state. With this structure, such rotations of the cams 340 by the urging forces of the second springs 330 are less likely to result in generation of collision noise among the rotated cams 340 and gears meshing therewith.

The braking mechanism 500 of the embodiment includes the spring clutch 540 serving as a mechanism for applying braking force to the cams 340 to prevent pivoting of the cams 340 in the second prescribed direction. With this provision of the spring clutch 540, the braking mechanism 500 is less susceptible to the heat from the heater 110, unlike a braking mechanism employing oil to apply braking force.

In the braking mechanism 500 of the embodiment, the spring clutch 540 is provided over the shaft 530 which is coaxial with a rotation center of the second gear 520, Compared to a structure where a spring clutch is disposed over a shaft portion of a cam, for example, the structure of the embodiment can realize reduction in diameter of the shaft SF of the cam 340, and, hence, the cam 340 can be made more compact.

In the depicted embodiment, the drive gear 120G is provided at a side closer one end of the rotary body 120 in the axial direction, while the braking mechanism 500 is provided at another side closer to the other end of the rotary body 120 in the axial direction. This structure can contribute to downsizing of the fixing device 8, compared to a configuration in which a drive gear and a braking mechanism are disposed on the same side of the rotary body 120 in the axial direction.

The braking mechanism 500 is disposed opposite to the heater 110 with respect to the corresponding side frame 83 in the present embodiment. With this structure, the side frame 83 can function to suppress transmission of the heat from the heater 110 to the braking mechanism 500.

The belt 130 is configured to be nipped between the rotary body 120 and each of the upstream pad P1 and the downstream pad P2, not only while the nip pressure is the first nip pressure but also while the nip pressure is the second nip pressure. With this structure of the embodiment, there is less variation in the nip pressure distribution in the conveying direction of the sheet S, compared to a configuration where a belt is nipped between a rotary body and only one of two pads under the second nip pressure. Accordingly, degradation in image quality and deterioration in the transportability of the sheet S can be suppressed.

The nip pressure can be changed from the first nip pressure to the second nip pressure with substantially no change in the posture of the arm 310 in the depicted embodiment. This structure of the embodiment is advantageous, compared to a such configuration that a change in posture of an arm causes a change in nip pressure, in order to restrain variation in distribution of the nip pressure, as well as to maintain the width of the nip region NP substantially constant.

In the present embodiment, the fixing device 8 is an example of a fixing device. The rotary body 120 is an example of a rotary body. The pressure unit 82 is an example of a pressure body. The frame FL is an example of a frame. The pressure varying mechanism 300 is an example of a pressure varying mechanism. The upstream pad P1 is an example of a first pad. The downstream pad P2 is an example of a second pad. The second end portion 311B is an example of a first portion. The engagement hole portion 311C is an example of a second portion. The screw 360 is an example of a restricting member. The first spring 320 is an example of a first spring. The second spring 330 is an example of a second spring. The first compression state of the second spring 330 is an example of a first deformed state. The second compression state of the second spring 330 is an example of a second deformed state. The third compression state of the second spring 330 is an example of a third deformed state.

Variations and Modifications to the Embodiment

The present disclosure should not be limited to the depicted embodiment, but various modifications may be available to the embodiment, as will be described below. In the following description, like parts and components will be designated with reference numerals the same as those of the above-described embodiment for the sake of simplifying description, and descriptions therefor will be omitted.

In the embodiment described above, the first spring 320 (as the first spring) is a helical tension spring, and the second spring 330 (as the second spring) is a compressive coil spring. Alternatively, the first spring may be a compressive coil spring and the second spring may be a helical tension spring.

Figure 12:
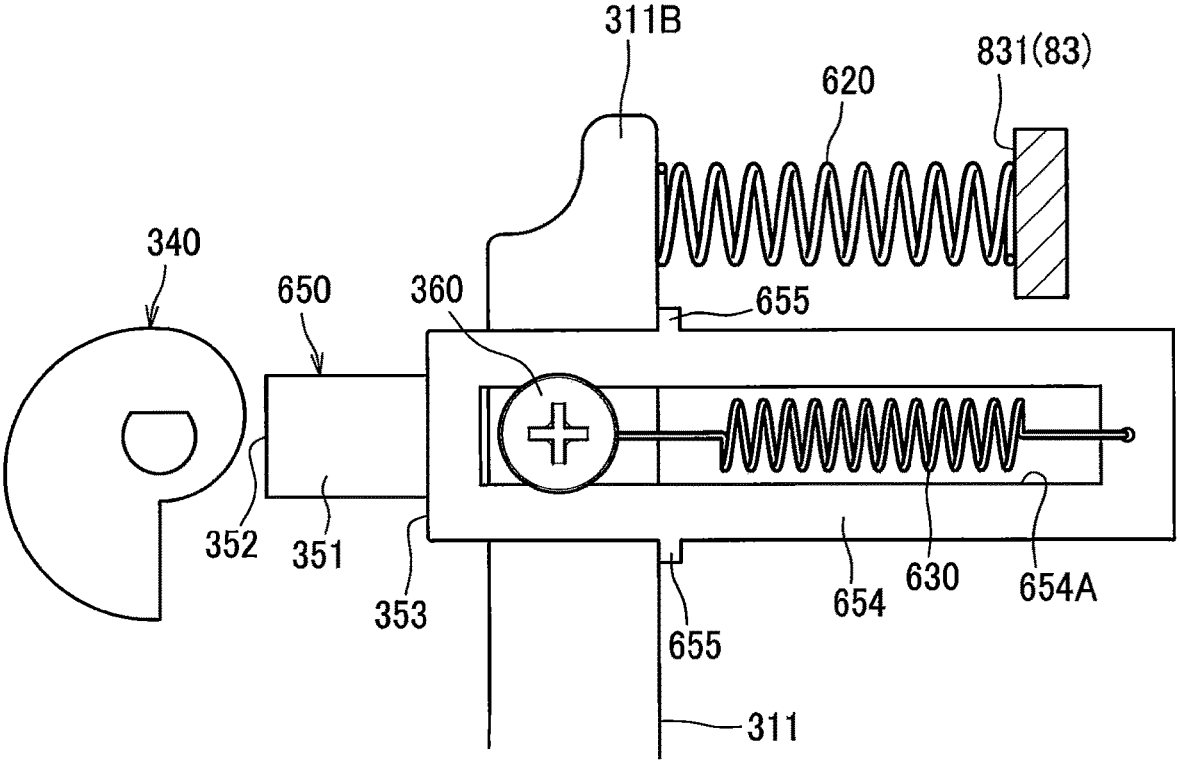
FIG. 12 is a view illustrating a pressure varying mechanism according to a first modification to the embodiment.

For example, FIG. 12 illustrates a pressure varying mechanism 600 according to a first modification to the embodiment. In this example, a first spring 620 (as the first spring) is compression spring, and a second spring 630 (as the second spring) is a tension spring. Further, a cam follower 650 is provided instead of the cam follower 350 of the embodiment. The cam follower 650 has a structure slightly different from that of the cam follower 350.

Specifically, each cam follower 650 of the first modification includes an extending portion 654, in addition to the cylindrical portion 351, the contact portion 352, and the flange portion 353 of the depicted embodiment. The extending portion 654 has a different structure from the extending portion 354 of the embodiment.

The extending portion 654 extends from the flange portion 353 in a direction away from the cylindrical portion 351. The extending portion 654 has an elongated hole 654A for engagement with the large-diameter portion 362 of the corresponding screw 360 fixed to the corresponding arm body 311. The extending portion 654 is slidable along a side surface of the corresponding arm body 311. Note that, in this first modification, the screw 360 does not function as the restricting member.

The extending portion 654 has two projections 655 in engagement with a periphery of the arm body 311, the periphery farther away from the cam 340. The projections 655 function to restrict the cam follower 650 as a whole from moving toward the cam 340. That is, in this first modification, the projections 655 serve as the restricting member.

Further, the first spring 620 has one end in contact with, or fixed to, a spring fixing portion 831 provided at each side frame 83. Another end of the first spring 620 is in contact with the second end portion 311B of the arm body 311. The second spring 630 has one end connected to the screw 360, and another end connected to an end portion of the extending portion 654 farther away from the cam 340.

With this structure of the first modification, the urging forces of the first spring 620 and the second spring 630 are applied to the arm body 311 in a similar manner as the urging forces of the first spring 320 and the second spring 330 according to the embodiment described above. Likewise, the cams 340 can deform the second springs 630 in a similar manner as in the above-described embodiment. Accordingly, similar technical advantageous as those of the depicted embodiment can be achieved.

Figure 13:
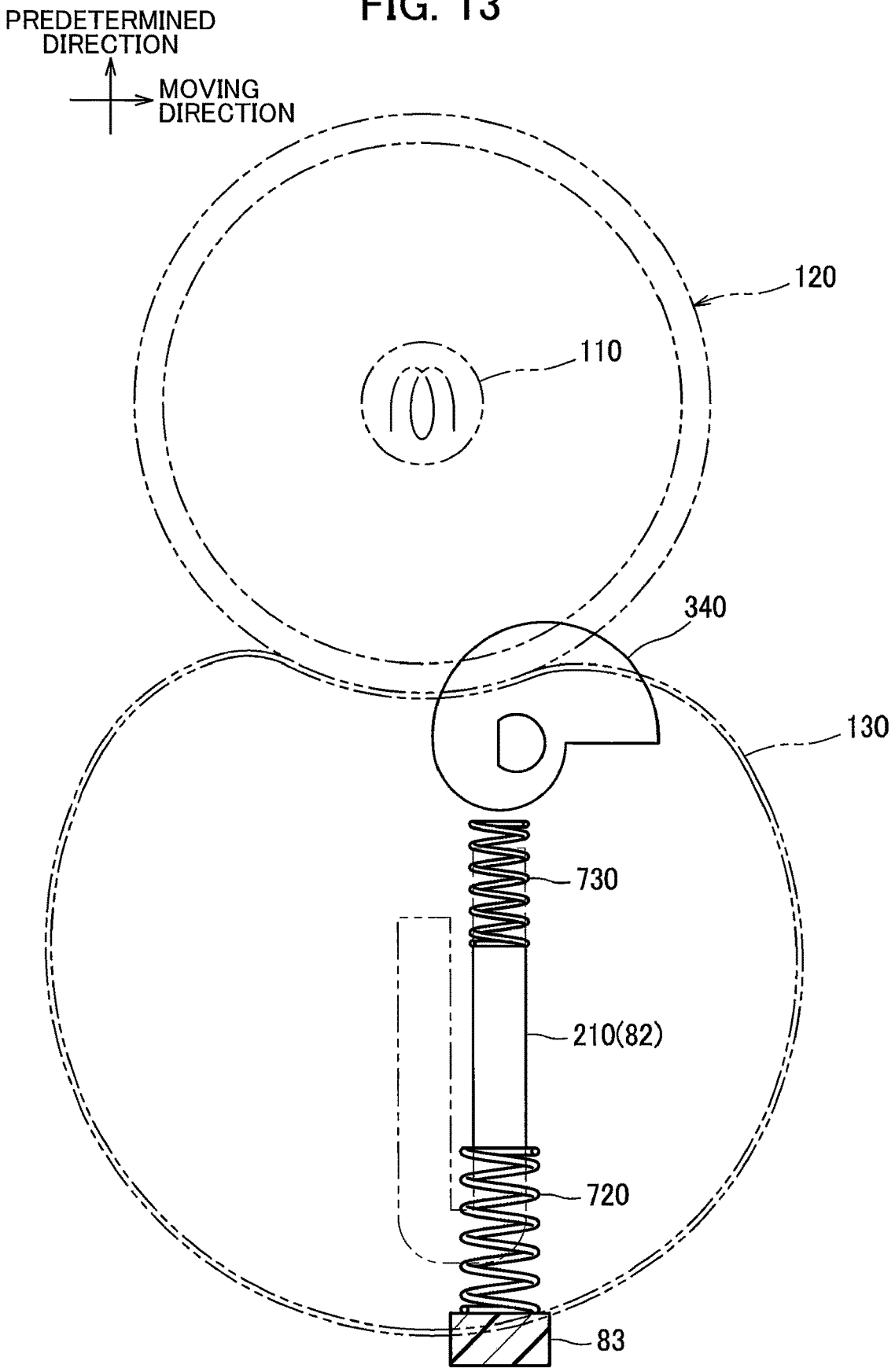
FIG. 13 is a view illustrating a pressure varying mechanism according to a second modification to the embodiment.

FIG. 13 illustrates a pressure varying mechanism 700 according to a second modification to the embodiment.

In the above-described embodiment, the urging forces of the first springs 320 and the second springs 330 are applied to the pressure unit 82 through the respective arms 310. Alternatively, in the structure of the second modification, urging forces of the first and second springs are applicable directly to the pressure unit 82.

Specifically, in the second modification, a first spring 720 (as the first spring) and a second spring 730 (as the second spring) are both compression springs. Further, in the second modification, widthwise end portions of the first stay 210 are extended further outward than those in the depicted embodiment. The first spring 720 and the second spring 730 are arranged to interpose each extended widthwise end portion of the first stay 210 therebetween in the predetermined direction.

One end of each first spring 720 is supported by the corresponding side frame 83, and another end of each first spring 720 is in contact with the corresponding widthwise end portion of the first stay 210. One end of each second spring 730 is fixed to the corresponding widthwise end portion of the first stay 210, and another end of each second spring 730 is disposed to face the corresponding cam 340.

With this structure, only the urging force of the first spring 720 (first urging force) can be applied to provide the first nip pressure at the nip region NP, as in the depicted embodiment. Further, in order to provide the second nip pressure at the nip region NP, both of the urging force of the first spring 720 (first urging force) and the urging force of the second spring 730 (second urging force) can be applied to the pressure unit 82.

Still further variations are also conceivable.

For example, the first spring and the second spring of the disclosure may not necessarily be coil springs, but may be torsion springs or leaf springs.

In the embodiment described above, the rotary body 120 (as an example of a rotary body) is a cylindrical roller incorporating the heater 110. However, the rotary body of the present disclosure may be, for example, an endless belt whose inner peripheral surface is configured to be heated by a heater. Still alternatively, the rotary body may be heated through an external heating method, according to which a heater disposed outside of the rotary body is configured to heat an outer peripheral surface of the rotary body. Still alternatively, the rotary body may be heated through an IH (induction heating) method. Still alternatively, a heater may be disposed inside a belt and indirectly heat the rotary body disposed in contact with an outer peripheral surface of the belt. Still alternatively, a heater may be incorporated in each of the rotary body and the belt.

The pressure body of the disclosure is exemplified as the pressure unit 82 in the embodiment, but the pressure body may be exemplified as a pressure roller, for example.

The pressure body (pressure unit 82) is urged toward the rotary body (rotary body 120) in the depicted embodiment. Alternatively, the rotary body may be urged toward the pressure body. That is, the first urging force and the second urging force may be applied to the rotary body, rather than to the pressure body.

The pressure varying mechanism 300 of the embodiment includes the pivotable cams 340. Alternatively, available are: a mechanism for pushing the second spring with a linearly movable cam; or a mechanism for deforming the second spring by reciprocal movements of a rod of an air cylinder.

The fixing device 8 of the embodiment (as an example of the fixing device) includes the heater 110. Alternatively, the fixing device of the disclosure may a fixing device without a heater. For example, the fixing device may be configured to fix a developer image on a sheet by irradiating light onto a nip region.

The heater 110 of the embodiment is a halogen lamp. However, the heater of the disclosure may be a carbon heater, for example.

In the spring clutch 540 of the embodiment, the tightening portion 541 is provided in a form of a coiled portion of a coil spring. Alternatively, a tightening portion may have shapes other than a coiled shape, for example, an arcuate shape. In a case where the tightening portion is arcuate shaped, the spring clutch may be an arcuate-shaped leaf spring. Still alternatively, the spring clutch of the disclosure may be provided as a torsion coil spring.

In the braking mechanism 500 according to the embodiment, the spring clutch 540 fixed to the second gear 520 is configured to rotate relative to the shaft 530 fixed to the corresponding side frame 83. Alternatively, the braking mechanism of the disclosure may have a configuration where a shaft fixed to a second gear is rotatable relative to a spring clutch fixed to a frame.

In the above-described embodiment, the upstream pad P1 and the downstream pad P2 are made of rubber. However, a pad of the disclosure may be made of, for example, a material having a sufficient hardness and unlikely to elastically deform even under application of pressure, such as resin or metal, for example.

In the embodiment described above, the holder 140 and the stay 200 both function as a supporting member. Alternatively, only one of the holder 140 and the stay 200 may serve as the supporting member. Still alternatively, the holder and the stay may be integrated into a single component.

The developer-image forming unit 5 of the depicted embodiment mainly includes the photosensitive drum 61 and the charger 62. Alternatively, a developer-image forming unit may include a belt-shaped photosensitive body and a charging roller.

The components described in the above-described embodiment and the modifications thereto may be combined with one another as appropriate.

While the description has been made in detail with reference to the embodiments, it would be apparent to those skilled in the art that many modifications and variations may be made thereto.

What is claimed is:

1. A fixing device comprising:

a rotary body;

a pressure body configured to form a nip region in cooperation with the rotary body;

a frame supporting the rotary body; and a pressure varying mechanism configured to provide a nip pressure to be applied to the nip region formed between the rotary body and the pressure body, the pressure varying mechanism comprising:

a first spring configured to apply a first urging force to one of the rotary body and the pressure body, the first urging force acting in a first urging direction; and a second spring configured to apply a second urging force to the one of the rotary body and the pressure body, the second urging force acting in a second urging direction opposite to the first urging direction, the pressure varying mechanism being configured to vary the nip pressure to be applied to the nip region between a first nip pressure and a second nip pressure smaller than the first nip pressure, the first nip pressure being applied to the nip region while the first urging force of the first spring is applied to the one of the rotary body and the pressure body without application of the second urging force of the second spring to the one of the rotary body and the pressure body, and the second nip pressure being applied to the nip region while both of the first urging force of the first spring and the second urging force of the second spring are applied to the one of the rotary body and the pressure body.

2. The fixing device according to claim 1, wherein the first spring has one end connected to the frame.

3. The fixing device according to claim 2, further comprising an arm pivotably movably supported by the frame, wherein the first spring is configured to apply the first urging force to the one of the rotary body and the pressure body through the arm, and wherein the second spring is configured to apply the second urging force to the one of the rotary body and the pressure body through the arm.

4. The fixing device according to claim 3, wherein the pressure varying mechanism further comprises a cam supported by the frame, the cam being configured to shift a state of the second spring between a first deformed state and a second deformed state more deformed than the first deformed state, the second urging force of the second spring being not applied to the one of the rotary body and the pressure body in the first deformed state, and the second urging force of the second spring being applied to the one of the rotary body and the pressure body in the second deformed state.

5. The fixing device according to claim 4, wherein the arm comprises:

an arm body connected to another end of the first spring; and a cam follower movably supported by the arm body, the cam follower being configured to make contact with the cam, the second spring being disposed between the arm body and the cam follower.

6. The fixing device according to claim 5, wherein the arm further comprises a restricting member configured to restrict the cam follower from moving toward the cam, wherein the cam follower is in contact with the restricting member while the second spring is in the first deformed state.

7. The fixing device according to claim 6, wherein the second spring is deformed from a state thereof having a natural length in the first deformed state.

8. The fixing device according to claim 5, wherein the cam is further configured to shift the state of the second spring from the second deformed state to a third deformed state more deformed than the second deformed state, and wherein a portion of the cam follower is nipped between the cam and the arm body while the second spring is in the third deformed state.

9. The fixing device according to claim 8, wherein:

the arm body is in a first posture while the second spring is in the first deformed state;

the arm body is in the first posture while the second spring is in the second deformed state; and the arm body is in a second posture different from the first posture while the second spring is in the third deformed state.

10. The fixing device according to claim 9, wherein the pressure body comprises:

a belt configured to move in a moving direction;

a first pad configured to nip the belt in cooperation with the rotary body;

a second pad positioned to be spaced apart from the first pad in the moving direction and configured to nip the belt in cooperation with the rotary body; and a supporting member supporting the first pad and the second pad, the supporting member being supported by the arm body, wherein, while the arm body is in the first posture, both of the first pad and the second pad nip the belt in cooperation with the rotary body, and wherein, while the arm body is in the second posture, the first pad nips the belt in cooperation with the rotary body but the second pad does not nip the belt in cooperation with the rotary body.

11. The fixing device according to claim 5, wherein the arm body comprises a guide protrusion protruding toward the cam, and wherein the cam follower comprises a cylindrical portion coupled over the guide protrusion.

12. The fixing device according to claim 11, wherein the second spring is a coil spring providing an internal space therein, the second spring being disposed between the cylindrical portion and the arm body with the guide protrusion extending through the internal space.

13. The fixing device according to claim 4, wherein the arm comprises:

a first portion in contact with the first spring; and a second portion supporting the one of the rotary body and the pressure body, the cam being positioned between the first portion and the second portion in a direction from the first portion toward the second portion.

14. The fixing device according to claim 4, further comprising a heater configured to heat the rotary body, the rotary body extending in an axial direction, wherein the frame comprises a pair of side frames and a connecting frame connected to each of the pair of side frames, the side frames being positioned at respective end portions of the rotary body in the axial direction, the connecting frame having a portion positioned between the heater and the cam.

15. The fixing device according to claim 4, wherein the pressure varying mechanism further comprises:

a cam drive mechanism configured to rotate the cam in a first prescribed direction to shift the state of the second spring from the first deformed state to the second deformed state, and in a second prescribed direction opposite to the first prescribed direction to shift the state of the second spring from the second deformed state to the first deformed state; and a braking mechanism configured to apply a prescribed resisting force to the cam in a case where the cam is rotated in the second prescribed direction, the prescribed resisting force being greater than a resisting force to be applied to the cam while the cam is rotated in the first prescribed direction.

16. The fixing device according to claim 15, wherein the braking mechanism comprises:

a shaft portion; and a spring clutch comprising a tightening portion disposed over the shaft portion, the tightening portion having one of a coiled shape and an arcuate shape, the shaft portion and the tightening portion being rotatable relative to each other in accordance with a rotation of the cam, the tightening portion being configured to tighten the shaft portion to apply the prescribed resisting force to the cam while the cam is rotated in the second prescribed direction.

17. The fixing device according to claim 15, further comprising a drive gear configured to rotate the rotary body, wherein the rotary body extends in an axial direction and having one end portion and another end portion opposite each other in the axial direction, the drive gear being provided at the one end portion of the rotary body and the braking mechanism being provided at the another end portion of the rotary body in the axial direction.

18. The fixing device according to claim 1, wherein the pressure body comprises:

a belt configured to move in a moving direction;

a first pad configured to nip the belt in cooperation with the rotary body;

a second pad positioned to be spaced apart from the first pad in the moving direction and configured to nip the belt in cooperation with the rotary body; and a supporting member supporting the first pad and the second pad, wherein the first spring is configured to apply the first urging force to the pressure body such that both of the first pad and the second pad are urged toward the rotary body through the supporting member, and wherein the belt is nipped between the rotary body and each of the first pad and the second pad while either the first nip pressure or the second nip pressure is applied to the nip region as the nip pressure.

19. The fixing device according to claim 1, wherein the rotary body comprises:

a heater; and a roller defining an internal space therein, the heater being disposed in the internal space.

20. A fixing device comprising:

a roller;

a belt;

a pad configured to nip the belt in cooperation with the roller;

a supporting member supporting the pad;

a frame supporting the roller;

an arm pivotally movably supported by the frame and supporting the supporting member;

a first spring connecting the arm to the frame and urging the pad toward the roller through the supporting member;

a second spring configured to urge the pad in a direction opposite to a direction in which the first spring urges the pad; and a cam pivotally movably supported by the frame and configured to move the arm between a first posture and a second posture different from the first posture, the cam being configured to shift a state of the second spring between a first deformed state and a second deformed state more deformed than the first deformed state while maintaining the arm in the first posture.

* * * * *